US009603459B2

(12) United States Patent
Brykalski et al.

(10) Patent No.: US 9,603,459 B2
(45) Date of Patent: Mar. 28, 2017

(54) THERMALLY CONDITIONED BED ASSEMBLY

(75) Inventors: Michael J. Brykalski, Monrovia, CA (US); Jay C. Clark, Arcadia, CA (US); Brian D. Comiskey, Coto de Caza, CA (US)

(73) Assignee: Genthem Incorporated, Northville, MI (US)

( * ) Notice: Subject to any disclaimer, the term of this patent is extended or adjusted under 35 U.S.C. 154(b) by 0 days.

(21) Appl. No.: 13/620,383

(22) Filed: Sep. 14, 2012

(65) Prior Publication Data

US 2013/0097776 A1 Apr. 25, 2013

Related U.S. Application Data

(63) Continuation of application No. 13/303,895, filed on Nov. 23, 2011, which is a continuation of application No. 11/872,657, filed on Oct. 15, 2007, now Pat. No. 8,065,763.

(60) Provisional application No. 60/851,574, filed on Oct. 13, 2006, provisional application No. 60/971,197, filed on Sep. 10, 2007.

(51) Int. Cl.
*A47C 21/04* (2006.01)

(52) U.S. Cl.
CPC ..... *A47C 21/044* (2013.01); *A47C 21/048* (2013.01)

(58) Field of Classification Search
CPC ..... A47C 21/04
USPC ..... 5/421, 423, 426, 505.1, 652.2; 62/3.5
See application file for complete search history.

(56) References Cited

U.S. PATENT DOCUMENTS

| | | | |
|---|---|---|---|
| 96,989 | A | 11/1869 | Somes |
| 771,461 | A | 10/1904 | Clifford |
| 1,777,982 | A | 6/1929 | Popp |
| 2,461,432 | A | 2/1949 | Mitchell |
| 2,462,984 | A | 3/1949 | Maddison |
| 2,493,067 | A | 1/1950 | Goldsmith |

(Continued)

FOREIGN PATENT DOCUMENTS

| | | |
|---|---|---|
| CN | 101 219 025 | 7/2008 |
| DE | 10238552 | 8/2001 |

(Continued)

OTHER PUBLICATIONS

Feher, Steve, Thermoelectric Air Conditioned Variable Temperature Seat (VTS) & Effect Upon Vehicle Occupant Comfort, Vehicle Energy Efficiency, and Vehicle Environment Compatibility, SAE Technical Paper, Apr. 1993, pp. 341-349.

(Continued)

*Primary Examiner* — Fredrick Conley
(74) *Attorney, Agent, or Firm* — Knobbe, Martens, Olson & Bear, LLP

(57) ABSTRACT

A climate controlled bed comprises a cushion member having an outer surface comprising a first side for supporting an occupant and a second side, the first side and the second side generally facing in opposite directions. In some embodiments, the cushion member includes one or more recessed areas along its first side or its second side. In one embodiment, the bed further includes a flow conditioning member that may be at least partially positioned with the recessed area of the cushion member, an air-permeable topper member positioned along the first side of the cushion member and a fluid temperature regulation system.

19 Claims, 21 Drawing Sheets

(56) References Cited

U.S. PATENT DOCUMENTS 2,512,559 A 6/1950 Williams
2,782,834 A 2/1957 Vigo
2,791,956 A 5/1957 Guest
2,931,286 A 4/1960 Fry, Sr. et al.
2,976,700 A 3/1961 Jackson
3,030,145 A 4/1962 Kottemann
3,039,817 A 6/1962 Taylor
3,136,577 A 6/1964 Richard
3,137,523 A 6/1964 Karner
3,209,380 A 10/1965 Watsky
3,266,064 A 8/1966 Figman
3,529,310 A 9/1970 Olmo
3,550,523 A 12/1970 Segal
3,653,083 A 4/1972 Lapidus
3,928,876 A 12/1975 Starr
4,413,857 A 11/1983 Hayashi
4,423,308 A 12/1983 Callaway et al.
4,563,387 A 1/1986 Takagi et al.
4,671,567 A 6/1987 Frobose
4,685,727 A 8/1987 Cremer et al.
4,712,832 A 12/1987 Antolini et al.
4,777,802 A 10/1988 Feher
4,793,651 A 12/1988 Inagaki et al.
4,825,488 A 5/1989 Bedford
4,853,992 A 8/1989 Yu
4,859,250 A 8/1989 Buist
4,905,475 A 3/1990 Tuomi
4,923,248 A 5/1990 Feher
4,981,324 A 1/1991 Law
4,997,230 A 3/1991 Spitalnick
5,002,336 A 3/1991 Feher
5,016,304 A 5/1991 Ryhiner
5,077,709 A 12/1991 Feher
5,102,189 A 4/1992 Saito et al.
5,106,161 A 4/1992 Meiller
5,117,638 A 6/1992 Feher
5,125,238 A 6/1992 Ragan et al.
5,265,599 A 11/1993 Stephenson et al.
5,335,381 A 8/1994 Chang
5,367,728 A 11/1994 Chang
5,372,402 A 12/1994 Kuo
5,382,075 A 1/1995 Shih
5,385,382 A 1/1995 Single, II et al.
5,416,935 A 5/1995 Nieh
5,419,489 A 5/1995 Burd
5,433,741 A 7/1995 Truglio
5,448,788 A 9/1995 Wu
5,473,783 A 12/1995 Allen
5,493,742 A 2/1996 Klearman
5,524,439 A 6/1996 Gallup et al.
5,584,084 A 12/1996 Klearman et al.
5,597,200 A * 1/1997 Gregory et al. ..... 297/180.13
5,613,729 A 3/1997 Summer, Jr.
5,613,730 A 3/1997 Buie et al.
5,626,021 A 5/1997 Karunasiri et al.
5,626,386 A 5/1997 Lush
5,640,728 A 6/1997 Graebe
5,642,539 A 7/1997 Kuo
5,645,314 A 7/1997 Liou
5,675,852 A 10/1997 Watkins
5,692,952 A 12/1997 Chih-Hung
5,715,695 A 2/1998 Lord
5,850,741 A 12/1998 Feher
5,871,151 A 2/1999 Fiedrich
5,887,304 A * 3/1999 von der Heyde ..... 5/726
5,902,014 A 5/1999 Dinkel et al.
5,921,314 A 7/1999 Schuller et al.
5,921,858 A 7/1999 Kawai et al.
5,924,766 A 7/1999 Esaki et al.
5,924,767 A 7/1999 Pietryga
5,927,817 A 7/1999 Ekman et al.
5,934,748 A 8/1999 Faust et al.
5,948,303 A 9/1999 Larson
5,963,997 A 10/1999 Hagopian
6,003,950 A 12/1999 Larsson
6,006,524 A 12/1999 Park
6,019,420 A 2/2000 Faust et al.
6,048,024 A 4/2000 Walllman
6,052,853 A 4/2000 Schmid
6,059,018 A 5/2000 Yoshinori et al.
6,062,641 A 5/2000 Suzuki et al.
6,073,998 A 6/2000 Siarkowski et al.
6,079,485 A 6/2000 Esaki et al.
6,085,369 A * 7/2000 Feher ..... 5/423
6,109,688 A 8/2000 Wurz et al.
6,119,463 A 9/2000 Bell
6,145,925 A 11/2000 Eksin et al.
6,148,457 A 11/2000 Sul
6,161,241 A 12/2000 Zysman
6,171,333 B1 1/2001 Nelson et al.
6,186,592 B1 2/2001 Orizakis et al.
6,189,966 B1 2/2001 Faust et al.
6,189,967 B1 2/2001 Short
6,196,627 B1 3/2001 Faust et al.
6,206,465 B1 3/2001 Faust et al.
6,223,539 B1 5/2001 Bell
6,263,530 B1 7/2001 Feher
6,291,803 B1 9/2001 Fourrey
6,336,237 B1 1/2002 Schmid
6,341,395 B1 1/2002 Chao
6,425,527 B1 7/2002 Smole
6,487,739 B1 12/2002 Harker
6,493,888 B1 12/2002 Salvatini et al.
6,493,889 B2 12/2002 Kocurek
6,497,720 B1 12/2002 Augustine et al.
6,509,704 B1 1/2003 Brown
6,511,125 B1 1/2003 Gendron
6,541,737 B1 4/2003 Eksin et al.
6,546,576 B1 4/2003 Lin
RE38,128 E 6/2003 Gallup et al.
6,581,224 B2 6/2003 Yoon
6,581,225 B1 6/2003 Imai
6,596,018 B2 7/2003 Endo et al.
6,598,251 B2 7/2003 Habboub et al.
6,604,785 B2 8/2003 Bargheer et al.
6,606,754 B1 8/2003 Flick
6,606,866 B2 8/2003 Bell
6,619,736 B2 9/2003 Stowe et al.
6,626,488 B2 9/2003 Pfahler
6,629,724 B2 10/2003 Ekern et al.
6,644,735 B2 11/2003 Bargheer et al.
6,676,207 B2 1/2004 Rauh et al.
6,684,437 B2 2/2004 Koenig
6,687,937 B2 2/2004 Harker
6,700,052 B2 3/2004 Bell
6,708,352 B2 3/2004 Salvatini et al.
6,711,767 B2 3/2004 Klamm
6,730,115 B1 5/2004 Heaton
6,761,399 B2 7/2004 Bargheer et al.
6,764,502 B2 7/2004 Bieberich
6,772,825 B2 8/2004 Lachenbuch et al.
6,782,574 B2 8/2004 Totton et al.
6,786,541 B2 9/2004 Haupt et al.
6,786,545 B2 9/2004 Bargheer et al.
6,808,230 B2 10/2004 Buss et al.
6,828,528 B2 12/2004 Stowe et al.
6,840,576 B2 1/2005 Ekern et al.
6,841,957 B2 1/2005 Brown
6,855,158 B2 2/2005 Stolpmann
6,855,880 B2 2/2005 Feher
6,857,697 B2 2/2005 Brennan et al.
6,857,954 B2 2/2005 Luedtke
6,871,365 B2 3/2005 Flick et al.
6,892,807 B2 5/2005 Fristedt et al.
6,893,086 B2 5/2005 Bajic et al.
6,904,629 B2 6/2005 Wu
6,907,739 B2 6/2005 Bell
6,954,944 B2 10/2005 Feher
6,967,309 B2 11/2005 Wyatt et al.
6,976,734 B2 12/2005 Stoewe
6,977,360 B2 12/2005 Weiss
6,990,701 B1 1/2006 Litvak
7,036,163 B2 5/2006 Schmid
7,036,575 B1 5/2006 Rodney et al.

(56) References Cited

U.S. PATENT DOCUMENTS 7,040,710 B2 5/2006 White et al.
7,052,091 B2 5/2006 Bajic et al.
7,063,163 B2 6/2006 Steele et al.
7,070,231 B1 7/2006 Wong
7,070,232 B2 7/2006 Minegishi et al.
7,100,978 B2 9/2006 Ekern et al.
7,108,319 B2 9/2006 Hartwich et al.
7,114,771 B2 10/2006 Lofy et al.
7,124,593 B2 10/2006 Feher
7,131,689 B2 11/2006 Brennan et al.
7,134,715 B1 11/2006 Fristedt et al.
7,147,279 B2 12/2006 Bevan et al.
7,165,281 B2 1/2007 Larssson et al.
7,168,758 B2 1/2007 Bevan et al.
7,178,344 B2 2/2007 Bell
7,181,786 B2 2/2007 Schoettle
7,201,441 B2 4/2007 Stoewe et al.
7,272,936 B2 9/2007 Feher
7,296,315 B2 11/2007 Totton et al.
7,338,117 B2 3/2008 Iqbal et al.
7,356,912 B2 4/2008 Iqbal et al.
7,370,911 B2 5/2008 Bajic et al.
7,425,034 B2 9/2008 Bajic et al.
7,462,028 B2 12/2008 Cherala et al.
7,469,432 B2 * 12/2008 Chambers ..... 5/423
7,475,464 B2 1/2009 Lofy et al.
7,478,869 B2 1/2009 Lazanja et al.
7,480,950 B2 1/2009 Feher
7,506,938 B2 3/2009 Brennan et al.
7,555,792 B2 7/2009 Heaton
7,587,901 B2 9/2009 Petrovski
7,591,507 B2 9/2009 Giffin et al.
7,640,754 B2 1/2010 Wolas
7,665,803 B2 2/2010 Wolas
7,708,338 B2 5/2010 Wolas
RE41,765 E 9/2010 Gregory et al.
7,827,620 B2 11/2010 Feher
7,827,805 B2 11/2010 Comiskey et al.
7,862,113 B2 1/2011 Knoll
7,866,017 B2 1/2011 Knoll
7,877,827 B2 2/2011 Marquette et al.
7,892,271 B2 2/2011 Schock et al.
7,908,687 B2 3/2011 Ward et al.
7,914,611 B2 3/2011 Vrzalik et al.
7,937,789 B2 5/2011 Feher
7,963,594 B2 6/2011 Wolas
7,966,835 B2 6/2011 Petrovski
7,996,936 B2 8/2011 Marquette et al.
8,065,763 B2 11/2011 Brykalski et al.
8,104,295 B2 1/2012 Lofy
8,143,554 B2 3/2012 Lofy
8,181,290 B2 5/2012 Brykalski et al.
8,191,187 B2 6/2012 Brykalski et al.
8,222,511 B2 7/2012 Lofy
8,256,236 B2 9/2012 Lofy
8,332,975 B2 12/2012 Brykalski et al.
8,359,871 B2 1/2013 Woods et al.
8,402,579 B2 3/2013 Marquette et al.
8,418,286 B2 4/2013 Brykalski et al.
8,434,314 B2 5/2013 Comiskey et al.
8,438,863 B2 5/2013 Lofy
RE44,272 E 6/2013 Bell
8,505,320 B2 8/2013 Lofy
8,516,842 B2 8/2013 Petrovski
8,539,624 B2 9/2013 Terech et al.
8,575,518 B2 11/2013 Walsh
8,621,687 B2 1/2014 Brykalski et al.
8,732,874 B2 5/2014 Brykalski et al.
8,782,830 B2 7/2014 Brykalski et al.
8,893,329 B2 11/2014 Petrovksi
9,105,808 B2 8/2015 Petrovski
9,105,809 B2 8/2015 Lofy
9,121,414 B2 9/2015 Lofy et al.
9,125,497 B2 9/2015 Brykalski et al.
9,186,479 B1 11/2015 Franceschetti et al.
9,335,073 B2 5/2016 Lofy
2002/0100121 A1 8/2002 Kocurek
2003/0019044 A1 1/2003 Larsson et al.
2003/0039298 A1 2/2003 Eriksson et al.
2003/0070235 A1 4/2003 Suzuki et al.
2003/0084511 A1 5/2003 Salvatini et al.
2003/0145380 A1 * 8/2003 Schmid ..... 5/423
2003/0150060 A1 8/2003 Huang
2003/0160479 A1 8/2003 Minuth et al.
2003/0188382 A1 10/2003 Klamm et al.
2003/0234247 A1 12/2003 Stern
2004/0090093 A1 5/2004 Kamiya et al.
2004/0177622 A1 9/2004 Harvie
2004/0255364 A1 12/2004 Feher
2005/0011009 A1 1/2005 Wu
2005/0086739 A1 4/2005 Wu
2005/0173950 A1 8/2005 Bajic et al.
2005/0278863 A1 12/2005 Bahash et al.
2005/0285438 A1 12/2005 Ishima et al.
2005/0288749 A1 12/2005 Lachenbruch
2006/0053529 A1 3/2006 Feher
2006/0053558 A1 3/2006 Ye
2006/0080778 A1 4/2006 Chambers
2006/0087160 A1 4/2006 Dong et al.
2006/0130490 A1 6/2006 Petrovski
2006/0137099 A1 * 6/2006 Feher ..... 5/713
2006/0137358 A1 6/2006 Feher
2006/0158011 A1 7/2006 Marlovits et al.
2006/0162074 A1 7/2006 Bader
2006/0197363 A1 9/2006 Lofy et al.
2006/0214480 A1 9/2006 Terech
2006/0244289 A1 11/2006 Bedro
2006/0273646 A1 12/2006 Comiskey et al.
2007/0035162 A1 2/2007 Bier et al.
2007/0040421 A1 2/2007 Zuzga et al.
2007/0069554 A1 3/2007 Comiskey et al.
2007/0086757 A1 4/2007 Feher
2007/0107450 A1 5/2007 Sasao et al.
2007/0138844 A1 6/2007 Kim
2007/0158981 A1 7/2007 Almasi et al.
2007/0193279 A1 8/2007 Yoneno et al.
2007/0200398 A1 8/2007 Wolas et al.
2007/0251016 A1 11/2007 Feher
2007/0261548 A1 11/2007 Vrzalik et al.
2007/0262621 A1 11/2007 Dong et al.
2007/0277313 A1 12/2007 Terech
2007/0296251 A1 12/2007 Krobok et al.
2008/0000025 A1 1/2008 Feher
2008/0028536 A1 2/2008 Hadden-Cook
2008/0047598 A1 2/2008 Lofy
2008/0087316 A1 4/2008 Inaba et al.
2008/0164733 A1 7/2008 Giffin et al.
2008/0166224 A1 7/2008 Giffin et al.
2008/0173022 A1 7/2008 Petrovski
2008/0263776 A1 10/2008 O'Reagan
2009/0000031 A1 1/2009 Feher
2009/0025770 A1 1/2009 Lofy
2009/0026813 A1 1/2009 Lofy
2009/0033130 A1 2/2009 Marquette et al.
2009/0106907 A1 4/2009 Chambers
2009/0126109 A1 5/2009 Lee
2009/0126110 A1 5/2009 Feher
2009/0211619 A1 8/2009 Sharp et al.
2009/0218855 A1 9/2009 Wolas
2010/0146700 A1 6/2010 Wolas
2010/0193498 A1 8/2010 Walsh
2010/0235991 A1 9/2010 Ward et al.
2010/0325796 A1 12/2010 Lachenbruch et al.
2011/0010850 A1 1/2011 Frias
2011/0041246 A1 2/2011 Li et al.
2011/0115635 A1 5/2011 Petrovski et al.
2011/0253340 A1 10/2011 Petrovski
2011/0271994 A1 11/2011 Gilley
2011/0289684 A1 12/2011 Parish et al.
2011/0314837 A1 12/2011 Parish et al.
2012/0017371 A1 1/2012 Pollard
2012/0080911 A1 4/2012 Brykalski et al.
2012/0114512 A1 5/2012 Lofy et al.
2012/0131748 A1 5/2012 Brykalski et al.

(56) References Cited

U.S. PATENT DOCUMENTS

| | | | |
|---|---|---|---|
| 2012/0261399 | A1 | 10/2012 | Lofy |
| 2012/0319439 | A1 | 12/2012 | Lofy |
| 2013/0086923 | A1 | 4/2013 | Petrovski et al. |
| 2013/0097776 | A1 | 4/2013 | Brykalski et al. |
| 2013/0097777 | A1 | 4/2013 | Marquette et al. |
| 2013/0198954 | A1 | 8/2013 | Brykalski et al. |
| 2013/0206852 | A1 | 8/2013 | Brykalski et al. |
| 2013/0227783 | A1 | 9/2013 | Brykalski et al. |
| 2013/0239592 | A1 | 9/2013 | Lofy |
| 2013/0269106 | A1 | 10/2013 | Brykalski et al. |
| 2014/0007594 | A1 | 1/2014 | Lofy |
| 2014/0026320 | A1 | 1/2014 | Marquette et al. |
| 2014/0030082 | A1 | 1/2014 | Helmenstein |
| 2014/0033441 | A1 | 2/2014 | Morgan et al. |
| 2014/0062392 | A1 | 3/2014 | Lofy et al. |
| 2014/0090513 | A1 | 4/2014 | Zhang et al. |
| 2014/0090829 | A1 | 4/2014 | Petrovski |
| 2014/0130516 | A1 | 5/2014 | Lofy |
| 2014/0131343 | A1 | 5/2014 | Walsh |
| 2014/0137569 | A1 | 5/2014 | Parish et al. |
| 2014/0159442 | A1 | 6/2014 | Helmenstein |
| 2014/0180493 | A1 | 6/2014 | Csonti et al. |
| 2014/0182061 | A1 | 7/2014 | Zaiss et al. |
| 2014/0187140 | A1 | 7/2014 | Lazanja et al. |
| 2014/0189951 | A1 | 7/2014 | DeFranks et al. |
| 2014/0194959 | A1 | 7/2014 | Fries et al. |
| 2014/0237719 | A1 | 8/2014 | Brykalski et al. |
| 2014/0250918 | A1 | 9/2014 | Lofy |
| 2014/0260331 | A1 | 9/2014 | Lofy et al. |
| 2014/0305625 | A1 | 10/2014 | Petrovski |
| 2014/0310874 | A1 | 10/2014 | Brykalski et al. |
| 2014/0338366 | A1 | 11/2014 | Adldinger et al. |
| 2015/0013346 | A1 | 1/2015 | Lofy |
| 2015/0238020 | A1 | 8/2015 | Petrovski et al. |
| 2015/0351556 | A1 | 12/2015 | Franceschetti et al. |
| 2015/0351700 | A1 | 12/2015 | Franceschetti et al. |
| 2015/0352313 | A1 | 12/2015 | Franceschetti et al. |
| 2015/0355605 | A1 | 12/2015 | Franceschetti et al. |
| 2015/0355612 | A1 | 12/2015 | Franceschetti et al. |
| 2016/0053772 | A1 | 2/2016 | Lofy et al. |
| 2016/0150891 | A1 | 6/2016 | Brykalski et al. |

FOREIGN PATENT DOCUMENTS

| | | |
|---|---|---|
| DE | 10115242 | 10/2002 |
| EP | 0 617 946 | 3/1994 |
| EP | 0 621 026 | 10/1994 |
| EP | 0 862 901 | 9/1998 |
| EP | 0878 150 | 11/1998 |
| EP | 1 064 905 | 1/2001 |
| EP | 1 804 616 | 2/2012 |
| EP | 2 921 083 | 9/2015 |
| FR | 1 327 862 | 5/1963 |
| FR | 2 790 430 | 9/2000 |
| FR | 2 893 826 | 6/2007 |
| GB | 2 251 352 | 12/2000 |
| JP | 56-97416 | 8/1981 |
| JP | S62-193457 U | 12/1987 |
| JP | H04-108411 | 4/1992 |
| JP | H06-343664 | 12/1994 |
| JP | H07-003403 | 1/1995 |
| JP | H09-140506 | 6/1997 |
| JP | H10-165259 | 6/1998 |
| JP | 10-227508 | 8/1998 |
| JP | 10-297243 | 11/1998 |
| JP | H11-266968 | 10/1999 |
| JP | 2000-060681 | 2/2000 |
| JP | 2003-254636 | 9/2003 |
| JP | 2004-174138 | 6/2004 |
| RU | 2297207 | 4/2007 |
| WO | WO 97/17930 | 5/1997 |
| WO | WO 99/02074 | 1/1999 |
| WO | WO 01/78643 | 10/2001 |
| WO | WO 01/84982 | 11/2001 |
| WO | WO 02/11968 | 2/2002 |
| WO | WO 02/058165 | 7/2002 |
| WO | WO 03/014634 | 2/2003 |
| WO | WO 03/051666 | 6/2003 |
| WO | WO 2005/120295 | 12/2005 |
| WO | WO 2007/060371 | 5/2007 |
| WO | WO 2007/089789 | 8/2007 |
| WO | WO 2008/046110 | 4/2008 |
| WO | WO 2008/057962 | 5/2008 |
| WO | WO 2009/036077 | 3/2009 |
| WO | WO 2010/009422 | 1/2010 |
| WO | WO 2010/129803 | 11/2010 |
| WO | WO 2011/026040 | 3/2011 |
| WO | WO 2011/150427 | 12/2011 |
| WO | WO 2012/061777 | 5/2012 |
| WO | WO 2015/188156 | 12/2015 |

OTHER PUBLICATIONS

Feher, Steve, Stirling Air Conditioned Variable Temperature Seat (SVTS) and Comparison with Thermoelectric Air Conditioned Variable Temperature Seat (VTS), SAE Technical Paper Series, International Congress and Exposition, No. 980661, Feb. 23-26, 1998, pp. 1-9.

Lofy, J. et al., Thermoelectrics for Environmental Control in Automobiles, Proceeding of Twenty-First International Conference on Thermoelectrics (ICT 2002), published 2002, pp. 471-476.

Okamoto et. al., The Effects of a Newly Designed Air Mattress upon Sleep and Bed Climate, Applied Human Science, vol. 16 (1997), No. 4 pp. 161-166.

Winder et al., Heat-retaining Mattress for Temperature Control in Surgery, Br Med J, Jan. 17, 1970 1:168.

I-CAR Advantage Online: The Climate Control Seat System, online article dated Aug. 27, 2001.

Product information for a "*Thermo-Electric Cooling & Heating Seat Cushion*"; retrieved on May 12, 2008 from http://www.coolorheat.com/.

Product information retrieved on Jan. 30, 2007 from http://store.yahoo.co.jp/maruhachi/28tbe20567.html (no English translation available).

Product information for "Kuchofuku's air conditioned bed, clothing line," retrieved on Oct. 11, 2007 from http://www.engadget.com/2007/06/29/kuchofukus-air-conditioned-bed-clothing-line/.

Product information for "SleepDeep™," retrieved on or about Jun. 2008 from http://www.sleepdeep.se.

International Search Report and Written Opinion received in PCT Application No. PCT/US07/81437, dated Apr. 14, 2008.

U.S. Appl. No. 15/213,281, filed Jul. 18, 2016, Petrovski.

Photographs and accompanying description of climate control seat assembly system components publicly disclosed as early as Jan. 1998.

Photographs and accompanying description of a component of a climate control seat assembly system sold prior to Nov. 1, 2005.

Photographs and accompanying description of a component of a climate control seat assembly system sold prior to Dec. 20, 2003.

U.S. Appl. No. 13/303,895, filed Nov. 23, 2011, Heated and Cooled Bed Assembly.

* cited by examiner

THERMALLY CONDITIONED BED ASSEMBLY

CROSS-REFERENCE TO RELATED APPLICATIONS

This application is a continuation application of U.S. patent application Ser. No. 13/303,895, filed Nov. 23, 2011, which is a continuation application of U.S. patent application Ser. No. 11/872,657, filed Oct. 15, 2007 and issued as U.S. Pat. No. 8,065,763 on Nov. 29, 2011, which claims the priority benefit under 35 U.S.C. §119(e) of U.S. Provisional Application No. 60/851,574, filed Oct. 13, 2006 and U.S. Provisional Application No. 60/971,197, filed Sep. 10, 2007, the entireties of all of which are hereby incorporated by reference herein.

BACKGROUND

Field

This application relates to climate control, and more specifically, to climate control of a bed or similar device.

Description of the Related Art

Temperature-conditioned and/or ambient air for environmental control of living or working space is typically provided to relatively extensive areas, such as entire buildings, selected offices, or suites of rooms within a building. In the case of enclosed areas, such as homes, offices, libraries and the like, the interior space is typically cooled or heated as a unit. There are many situations, however, in which more selective or restrictive air temperature modification is desirable. For example, it is often desirable to provide an individualized climate control for a bed or other device so that desired heating or cooling can be achieved. For example, a bed situated within a hot, poorly-ventilated environment can be uncomfortable to the occupant. Furthermore, even with normal air-conditioning, on a hot day, the bed occupant's back and other pressure points may remain sweaty while lying down. In the winter time, it is highly desirable to have the ability to quickly warm the bed of the occupant to facilitate the occupant's comfort, especially where heating units are unlikely to warm the indoor space as quickly. Therefore, a need exists to provide a climate-controlled bed assembly.

SUMMARY

In accordance with some embodiments of the present inventions, a climate controlled bed comprises a cushion member having an outer surface comprising a first side for supporting an occupant and a second side, the first side and the second side generally facing in opposite directions, the cushion member having at least one recessed area along its first side or its second side. In one embodiment, the bed further includes a support structure having a top side configured to support the cushion member, a bottom side and an interior space generally located between the top side and the bottom side, the top side and the bottom side of the support structure generally facing in opposite directions, a flow conditioning member at least partially positioned with the recessed area of the cushion member, an air-permeable topper member positioned along the first side of the cushion member and a fluid temperature regulation system. The fluid temperature regulation system includes a fluid transfer device, a thermoelectric device and a conduit system generally configured to transfer a fluid from the fluid transfer device to the thermoelectric device. The fluid temperature regulation system is configured to receive a volume of fluid and deliver it to the flow conditioning member and the topper member.

In one embodiment, a temperature control member for use in a climate controlled bed includes a resilient cushion material comprising at least one recessed area along its surface, at least one layer of a porous material, the layer being configured to at least partially fit within the recessed area of the cushion and a topper member being positioned adjacent to the cushion and the layer of porous material, the topper member being configured to receive a volume of air that is discharged from the layer of porous material towards an occupant.

According to some embodiments, a bed comprises a substantially impermeable mattress, having a first side and a second side, the first side and the second side being generally opposite of one another, the mattress comprising at least one openings extending from the first side to the second side, a flow conditioning member positioned along the first side of the mattress and being in fluid communication with the opening in mattress, at least one top layer being positioned adjacent to the flow conditioning member, wherein the flow conditioning member is generally positioned between the mattress and the at least one top layer and a fluid transfer device and a thermoelectric unit that are in fluid communication with the opening in the mattress and the flow conditioning member.

BRIEF DESCRIPTION OF THE DRAWINGS

These and other features, aspects and advantages of the present inventions are described with reference to drawings of certain preferred embodiments, which are intended to illustrate, but not to limit, the present inventions. The drawings include twenty-six (26) figures. It is to be understood that the attached drawings are provided for the purpose of illustrating concepts of the present inventions and may not be to scale.

DETAILED DESCRIPTION OF THE PREFERRED EMBODIMENTS

Various features and aspects of the embodiments disclosed herein are particularly useful in climate-controlled beds and similar devices, such as, for example, air chamber beds, adjustable beds, inner-spring beds, spring-free beds, memory foam beds, full foam beds, hospital beds, futons, sofas, reclining chairs, etc. However, it will be appreciated that such features and aspects may also be applied to other types of climate control seating assemblies, such as, for example, automobile or other vehicle seats, office chairs, sofas and/or the like.

Figure 1:
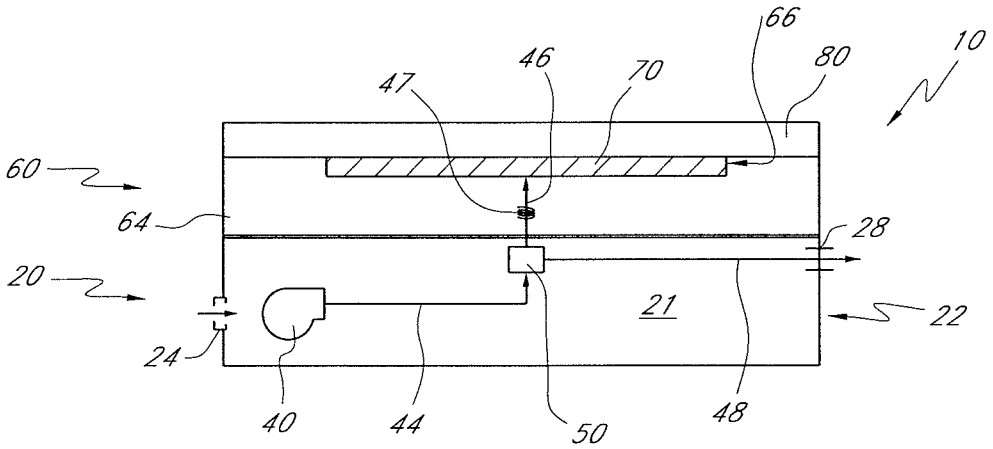
FIG. 1 illustrates a cross sectional schematic view of a climate controlled bed according to one embodiment.

With reference to the schematic illustration of FIG. 1, a bed 10 can include a climate control system. In the depicted embodiment, the bed 10 includes a lower portion 20 and an upper portion 60 situated above the lower portion 20. In some embodiments, the lower portion 20 comprises a frame 22, a spring box and/or any other member configured to support a mattress, cushion and/or any other portion of the upper portion 60. Preferably, the lower and upper portions 20, 60 are sized, shaped and otherwise configured to securely be positioned adjacent to one another. In other embodiments, the lower and upper portions 20, 60 comprise a unitary member.

The lower portion 20 can include side rails, top rails and/or other structural and non-structural components that together help define a substantially hollow interior space 21. Some or all of the components to the lower portion 20 can be manufactured from one or more rigid or semi-rigid materials, such as, for example, plastic (e.g., blow molded, extruded, thermoformed, etc.), metal (e.g., steel, iron, etc.), wood, fiberglass, other synthetics and the like.

As illustrated in FIG. 1, the interior space 21 of the frame 22 or other component of the lower portion 20 can include a fluid transfer device 40 (e.g., blower, fan, etc.), a thermoelectric device 50 (e.g., Peltier device), conduits 44, 46, 48 configured to hydraulically connect the various components and/or the like. In addition, the frame 22 preferably includes one or more inlets 24 and outlets 28 through which air or other fluid can enter or exit the interior space 21. Thus, as is described in greater detail herein, air or other fluid can enter the interior space 21 of the lower portion 20 through one or more inlets 24, be delivered by a fluid transfer device 40 past a thermoelectric device 50 for temperature conditioning and be directed toward the upper portion 60.

In some embodiments, the bed 10 comprises one or more larger openings through air or other fluid can enter the interior space 21. For example, the lower portion 20 can include an opening that extends across along the bottom or other area of the bed 10. Such an opening can encompass the entire bottom surface of the bed or only a portion of it, as desired or required. In some embodiments, such openings can be covered by one or more air permeable fabrics or other layers. For example, a bottom opening in a bed can be covered by one or more layers of an "open-weave" fabric.

Further, if air is temperature-conditioned by a thermoelectric device 40, a volume of waste air downstream may be generated and may need to be removed from the interior space 21. In some embodiments, waste line conduits 48 can be used to deliver waste air or other fluid to outlets 28. The quantity, location, spacing, size, shape, style, configuration and/or other characteristics of the inlets 24 and outlets 28 can be modified as desired or required by a particular application. For example, in some embodiments, the inlets 24 and/or outlets 28 comprise vents that are positioned along the vertical face of the frame 22 as illustrated in FIG. 1.

With continued reference to FIG. 1, the upper portion 60 can include a cushion member 64, such as a mattress, a pillow and/or the like. In some embodiments, the cushion member 64 comprises foam and/or one or more other materials capable of at least partially deforming when subjected to a force. A plurality of springs or other resilient members can be used to provide the desired level of resiliency to the upper portion 60, either in lieu of or in addition to the use of resilient materials (e.g., foam). Alternatively, the cushion member 64 can be replaced with a rigid or semi-rigid member that provides less or no resiliency.

In some embodiments, the cushion member 64 comprises a recessed area 66 along its top surface. In FIG. 1, the recessed area 66 is positioned near the middle of the cushion member 64 and does not extend to the edges of the cushion member 64. However, the size, dimensions, shape, location and other details of the recessed area 66 can be varied as desired or required by a particular application. Further, a cushion member 64 or an equivalent structure can include two or more recessed areas 66 along its top surface.

As illustrated in FIG. 1, the bed 10 can include a fluid conduit 46 that permits air or other fluid to be delivered from the fluid transfer device 40 to the recessed area 66 of the cushion member 64. The air or other fluid being transferred to the recessed area 66 can be selectively temperature-conditioned (e.g., cooled, heated). In order to accommodate any relative movement (e.g., vertical shifting) between the lower portion 20 and the upper portion 60 (e.g., cushion member 64), the fluid conduit 46 can include bellows or other deformable members as illustrated in FIG. 1. Thus, the fluid conduit 46 can move (e.g., compress, extend, rotate, twist, etc.) as the cushion member 64 in which it is positioned changes shape and position.

According to some embodiments, the recessed areas 66 of a cushion member 64 and/or any other component of the climate-controlled bed 10 can be configured to receive one or more flow conditioning members 70 or flow distribution members. The terms flow conditioning member and flow distribution members, which can be used interchangeably herein, are broad terms that can include any device, component, item or system capable of changing the flow pattern, direction or distribution of a fluid. As illustrated in FIG. 1, a single flow conditioning member 70 can be sized and shaped to fit generally snugly within a particular recessed area 66. However, in other arrangements, two or more flow conditioning members 70 can be placed within a single recessed area 66. In FIG. 1, the cushion member 64 and the flow conditioning member 70 situated therein form a substantially smooth top surface. Alternatively, the height, other dimensions and/or other characteristics of the flow conditioning member 70 can be selected so that the top surface of the combination of the cushion member 64 and flow conditioning member 70 is not smooth or flat. For example, in some embodiments, the height of the flow conditioning member 70 can be greater or less than the depth of the recessed area 66. Further, the width, length, shape and/or any other dimension of the flow conditioning member 70 can be different than the corresponding dimension of the recessed area 66.

Figure 1A:
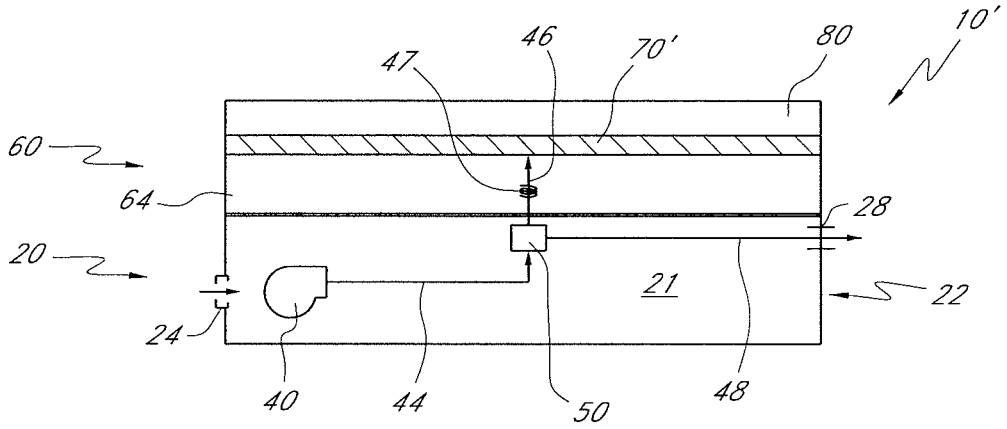
FIG. 1A illustrates a cross sectional schematic view of a climate controlled bed according to one embodiment.
Figure 2:
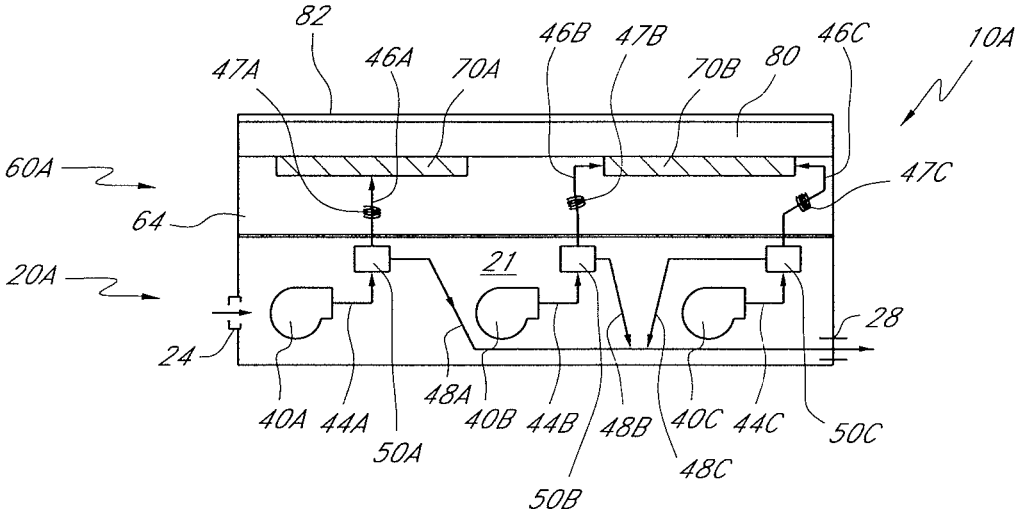
FIG. 2 illustrates a cross sectional schematic view of a climate controlled bed according to one embodiment.
Figure 2A:
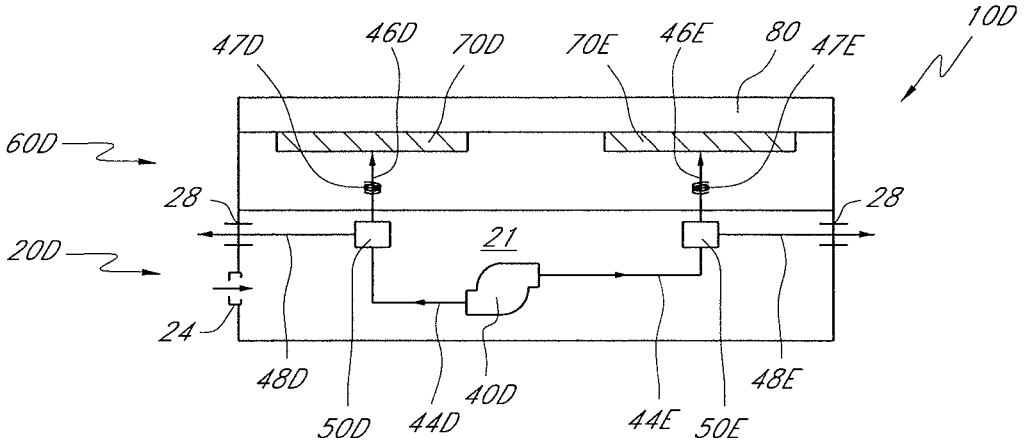
FIG. 2A illustrates a cross sectional schematic view of a climate controlled bed according to another embodiment.
Figure 2B:
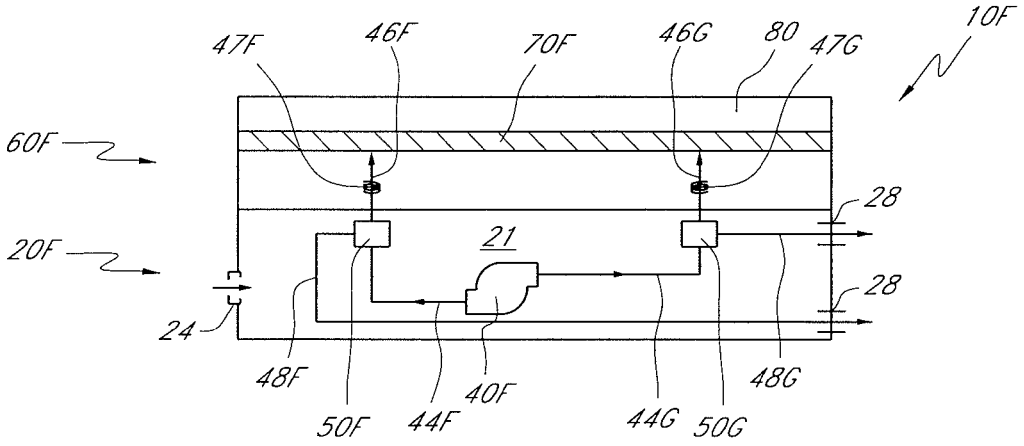
FIG. 2B illustrates a cross sectional schematic view of a climate controlled bed according to yet another embodiment.

In some embodiments, as illustrated by way of example in FIGS. 1A and 2B, the cushion member 64 does not include a recessed area 66. Thus, one or more flow conditioning members 70 can be placed on top of the cushion member 64 without the need or use for designated recessed areas 66 or the like. In such embodiments, the one or more flow conditioning members 70, the adjacent cushion member 64 and/or any other portion of the bed 10 can include guides, alignment members, fasteners, adhesives and/or any other items to help ensure that these components of the bed do not undesirably move relative to one another.

The flow conditioning member 70 can include a porous structure that is configured to receive a volume of air or other fluid from one or more inlets and distribute in a more even manner toward the side closest to the occupant. Thus, the flow conditioning member 70 can be used to advantageously spread the air (or other fluid) flow along its top surface as the air approaches an occupant.

In some embodiments, the flow conditioning member 70 comprises one or more resilient, rigid and/or semi-rigid materials having a porous structure (e.g., honeycomb, mesh, etc.). Such members can be formed using a generally intricate internal structure. For example, a porous foam can be used as the flow conditioning member 70. It will be appreciated, however, that softer or harder materials can also be used to fill the cavity of the recessed area 66, either in lieu of or in addition to foam. For instance, a semi-rigid or rigid thermoplastic, fiberglass and/or any other natural or synthetic material can be used.

The flow conditioning member 70 can include a single member or insert that can be placed within the recessed area 66 of the cushion member 60 (e.g., an insert, a spacer fabric or other component, a porous foam member, a bag or sac, etc.). Alternatively, the flow conditioning member 70 can comprise two or more different components (e.g., layers) that may or may not be attached to one another (e.g., a porous material situated within a shell, bag or the like). In one embodiment, flow condition member 70 includes an outer flange or other protruding member along its upper surface so as to better engage the corresponding surfaces of the cushion member 64. The flange (not shown) can be disposed partially or completely around the flow conditioning member 70 (e.g., air-permeable insert). The flow conditioning member 70 and the cushion member 60 can be separate member that can be attached or not attached to each other. Alternatively, the flow conditioning member 70 and the component into which it is positioned (e.g., the cushion member 60) can form a unitary structure.

Spacer fabrics or other porous structures can be situated within other flow conditioning devices or systems. For example, a spacer fabric, a porous foam, a bag or partial bag (e.g., completely or partially within a bag or similar device), an enclosure or partial enclosure and/or the like can be situated within a fluid distribution bag or other similar enclosure. The size, shape and other characteristics of such a bag/fabric combination can be configured to provide improved distribution coverage while maintaining a desired minimum air velocity. Preferably, the quantity, size and other properties of the fluid transfer devices (e.g., blower, pump, etc.) is selected based the area of the flow conditioning members included within a particular bed. Such a bag could be engineered or otherwise configured such that a fluid is permitted to move in some areas (e.g., towards the occupant) but not in other areas (e.g., the bottom, sides, away from the occupant, etc.).

As discussed, the flow conditioning member 70 can be in fluid communication with the fluid transfer device 40 and the fluid conduits 44, 46 placed therebetween. In addition, where temperature conditioning of air or other fluid being delivered by the fluid transfer device 40 is desired, the air or other fluid can pass through or past a thermoelectric device 50, as illustrated in the schematic of FIG. 1. In the illustrated embodiment, the fluid transfer device 40 and the thermoelectric device 50 are positioned within the interior space 21 of the lower portion 20. In alternative embodiments, however, one or more of these components and/or subcomponents of the climate control system can be positioned in another location (e.g., outside of the interior space 21, within a separate compartment, etc.). For example, in arrangements where the bed 10 includes a plurality of legs, the fluid transfer device 40, the fluid conduits, the thermoelectric device 50 and/or other items can be secured beneath the lower portion 20 of the bed 10. Also, where the bed includes a full foam or latex mattress, the blower and/or the thermoelectric device can be embedded within a portion or a surface of the mattress.

The embodiments described and/or illustrated herein can use a thermoelectric device 50 for temperature conditioning (e.g., selectively healing and/or cooling) the fluid flowing through the device. A preferred thermoelectric device is a Peltier thermoelectric module, which is well known in the art. Such devices typically include a main heat exchanger for transferring or removing thermal energy from the fluid flowing through the device and to the distribution systems. Typically, such devices also include a secondary (or waste) heat exchanger that extends from the thermoelectric device generally opposite the main heat exchanger. A single fluid transfer device 40 can be used to direct fluid over, through or in the vicinity of the main and/or waste heat exchangers for temperature conditioning purposes. In alternative embodiments, two or more fluid transfer devices can be used to move air or other fluid relative to the heat exchangers. For example, one fluid transfer device can be configured to convey air past the main heat exchanger while a second fluid transfer device can be configured to convey air past the waste heat exchanger.

In FIG. 1, air or other fluid is conveyed past the main heat exchanger of the thermoelectric device 50 toward the flow conditioning member 70 of the upper portion 60. In other embodiments, air or other fluid can be conveyed past a heating device (e.g., heating mat or pad, other type of heating device, etc.) or a cooling device, either in lieu of or in addition to a thermoelectric device for temperature conditioning purposes. For example, the bed 10 can comprise both a separate heating member and one more thermoelectric devices 50. In some embodiments, the heating member comprises a heating mat or pad, a PTC heater, a resistive wire heater and/or the like. In addition, fluid is moved past the waste heat exchanger of thermoelectric device 50 toward one or more outlets 28. Therefore, the bed 10 should have adequate inlet and outlet capacity to move air or other fluid into and out of the interior space 21 or any other area in which the fluid transfer devices 40 and the thermoelectric devices 50 and/or other temperature conditioning devices (e.g., heaters) are placed. Accordingly, the lower portion 20 can include a plurality of inlets 24 and outlets 28 as desired or required by a particular situation.

As discussed herein, a single climate-controlled bed 10 can include one, two or more sets of fluid transfer devices, thermoelectric devices, conduits and/or other components. Therefore, the interior space 21 of the lower portion 20 or any other area in which these components are positioned should be sized accordingly.

In some embodiments, the fluid transfer device 40 (e.g., fan, blower, etc.) and the downstream thermoelectric device 50 can be included as part of an integrated design, e.g., an integrated module. Therefore, the need for a separate conduit 44 to deliver air or other fluid from the fluid transfer device 40 to the thermoelectric device 50 can be eliminated.

With continued reference to FIG. 1, the bed 10 can include one or more top members 80 generally situated above the cushion member 64 and the flow conditioning member 70. In some embodiments, the top member 80 preferably comprises an air-permeable material so that air or other fluid exiting the top surface of the flow conditioning member 70 can be directed through the top member 80 toward an occupant. For example, the top member 80 can include one or more layers of air-permeable foam, a scrim or the like. Alternatively, a top member 80 can include a less air-permeable material or a substantially non air-permeable material. In such arrangements, the top member 80 can advantageously include a plurality of orifices or other openings that permit air or other fluid flow to move from the top surface of the flow conditioning member 70 towards the occupant of the bed 10.

With continued reference to FIG. 1, in some embodiments, the flow conditioning member 70 and the top member 80 can form a unitary member. In yet other embodiments, the flow conditioning member 70 and the top member 80 can be separate items that are attached or otherwise securely joined to one another. If the flow conditioning member 70 and the top member 80 are separate items, they can be configured to releasably attach to each other.

In addition, it will be appreciated that one or more layers or members can be added above, below and/or between the various components of the climate-controlled bed assemblies described and illustrated herein. Such layers or members can be used to provide additional comfort (e.g., cushioning), fatigue-relief and/or other advantages to an occupant. For example, an additional comfort layer or component can be included between the cushion member 64 and the top member 80. Moreover, such topper layers or members can be configured to provide resistance to fire and/or other hazards or elements.

Further, the bed can also comprise a heating device (e.g., resistive wire heater, heating pad, etc.) to supply heat and allow air to flow for cooling comfort. In addition, a non-slip friction layer can be positioned between the lower portion 20 and the upper portion (e.g., cushion member 64) to help prevent undesirable movement between the two portions.

One or more components of the bed 10, such as, for example, the top member 80 and the cushion member 64, can include a covering material (not shown). The covering material can be used to advantageously join various members and components of the bed together. According to some embodiments, the covering material is generally air-permeable and comprises a natural or synthetic fabric and/or the like.

In operation, according to one embodiment, ambient air enters the interior space 21 of the lower portion 20 of the bed via one or more inlets 24. As discussed, the bed can comprise one or more larger openings to permit air or other fluid to approach the fluid transfer devices 40. For example, the lower portion 20 can include an opening that extends across along the bottom or other area of the bed. Such an opening can encompass the entire bottom surface of the bed or only a portion of it, as desired or required. In some embodiments, such openings can be covered by one or more air permeable fabrics or other layers. For example, a bottom opening in a bed can be covered by one or more layers of an "open-weave" fabric.

The air is then drawn into an intake of one or more fluid transfer devices 40 and is conveyed past a thermoelectric device 50 using tubing or other conduit 44. The volume of air flowing past the main heat exchanger of the thermoelectric device 50 is selectively cooled and/or heated before being directed to the cushion member 64 of the upper portion 60 of the bed 10. This volume of temperature-conditioned air then enters one or more flow conditioning members 70 where it can be re-distributed toward the top surface of the bed 10. Alternatively, air or other fluid need not be temperature conditioned before being delivered to a flow conditioning member 70 or similar component. For example, air or other fluid can be delivered through, past or in the vicinity of a thermoelectric device that is not energized (e.g., not configured to cool or heat). In other embodiments, a fluid transfer device need not direct fluid through a thermoelectric device or other cooling/heating device at all.

Therefore, in some embodiments, the thermoelectric devices 50 can be turned on or off depending on whether thermal conditioning is desired or required. Further, the amount of thermal conditioning occurring to the fluid directed past a thermoelectric device 50 or other temperature conditioning device can be varied. In other words, the extent to which air or other fluid is temperature conditioned can be advantageously controlled by varying the voltage or electrical current being supplied to a thermoelectric device. Thus, the thermoelectric devices 50 can be configured to provide different amounts of heating and/or cooling based on the electrical current being supplied to them and/or other factors. Further, the speed of the fluid transfer devices 40 can be varied to control how much fluid is transferred to the flow conditioning members 70, either in addition to or in lieu of adjusting the extent of cooling or heating occurring at the thermoelectric device's heat exchangers.

In other embodiments, one or more other methods of controlling the temperature and/or fluid flowrate can be used. For example, one or more valves or other flow or pressure regulating devices can be used within the fluid distribution system between the fluid transfer devices 40 and the flow conditioning members 70. In other embodiments, the back pressure of the air delivery system can be advantageously adjusted to provide the flowrate and temperature of fluid to the bed assembly. In some arrangements, this can be accomplished at least in part by the use of valves or other flow or pressure regulating devices. In yet other embodiments, the types of spacer fabrics, flow conditioning members and/or other components of the climate controlled bed assembly can be modified to achieve the desired thermal conditioning effect.

The air can then flow toward an occupant situated on the bed 10 by passing through one or more air-permeable top members 80. In addition, a volume of ambient air flowing toward the thermoelectric device 50 will be directed to the waste heat exchanger where it also undergoes temperature conditioning (e.g., if air is cooled as it passes the main heat exchanger, air is heated as it passes the waste heat exchanger, and vice versa). This volume of waste air is then conveyed away from the interior space 21 of the lower portion 20 through one or more outlets 28. Alternatively, the waste air can be discharged into an interior portion 21 of the lower portion 20 without the use of a conduit to convey it from the thermoelectric device 50 to an outlet 28.

As discussed, the cushion member 64 need not include a recessed area. For example, in the embodiment of the bed 10' illustrated in FIG. 1A, the flow conditioning member 70' is generally positioned on top of the cushion member 64, but not within a recessed area or any other similar feature. In such arrangements, the flow conditioning member 70' can be sized, shaped and otherwise configured to cover some, most or all of the cushion member 64 positioned therebelow, as desired or required.

FIG. 2 illustrates an embodiment of a climate-controlled bed 10A that is similar to that shown in FIG. 1. Some of the differences between the two embodiments are highlighted herein.

As discussed, a climate-controlled bed 10A can include one, two or more fluid transfer devices 40A, 40B, 40C, thermoelectric devices 50A, 50B, 50C and other related components. By way of illustration, the bed 10A depicted in FIG. 2 comprises two flow conditioning members 70A, 70B. As shown, one of the flow conditioning members 70A is supplied temperature-conditioned air or other fluid by a single fluid transfer device 40A and a single thermoelectric device 50A. In contrast, the second flow conditioning member 70B received temperature-conditioned air or other fluid from two different sets of fluid transfer devices 40B, 40C and thermoelectric devices 50B, 50C.

With continued reference to FIG. 2, air or other fluid can be directed from the fluid transfer devices 40B, 40C to opposite sides of the flow conditioning member 70B via the respective thermoelectric devices 50B, 50C. In the depicted arrangement, air enters the flow conditioning member 70B generally from opposite side surfaces. Consequently, the fluid lines 46B, 46C can be routed accordingly. Alternatively, the fluid line 46A can enter the flow conditioning member 70A from the bottom surface and/or any other location. The hydraulic connections and details thereof (e.g., conduit type and size, orientation, routing, point(s) of entry into the respective flow conditioning member, etc.) can be customized as desired or required. As discussed herein with respect to other embodiments, the fluid lines 46A, 46B, 46C can be advantageously equipped with bellows 47A, 47B, 47C, expansion joints and/or other movable features that permit relative movement between the lower and upper portions, 20A, 60A of the bed 10A.

As shown in FIG. 2, air or other fluid routed past the various waste heat exchangers can be advantageously combined so as to reduce the complexity of the waste heat conduits and/or the number of outlets 28 that a particular climate-controlled bed assembly 10B includes. For example, in FIG. 2, waste fluid flow from all three thermoelectric devices 50A, 50B, 50C is collected in a main waste fluid conduit 48A and directed toward a single outlet 28. However, in other embodiments, it will be appreciated that different hydraulic arrangement can be used to collect and remove waste fluid from the interior space 21 of the lower portion 20. In addition, a lower portion 20 can comprise more inlets 24 and/or outlets 28 as illustrated and disclosed herein.

In the embodiment illustrated in FIG. 2, the bed 10A includes a top layer 82 situated above the top layer 80. As discussed, more or fewer top layers 80, 82, cushion members 64A, comfort layers and/or the like can be included in a particular climate-controlled bed assembly. In some embodiments, the lower top layer 80 can be configured to distribute air generally in a lateral direction and the upper top layer 82 can be configured to distribute air in a vertical direction (e.g., toward an occupant). It will be appreciated, however, that more or fewer top layers can be included in a particular bed assembly. In addition, the top layers can be configured to distribute or otherwise flow condition air differently than discussed herein. For example, one or more of the top layers can be configured to distribute air both vertically and laterally.

As illustrated in FIG. 2A, a single fluid transfer device 40D (e.g., fan, blower, etc.) can be used to transfer air or other fluid to two or more flow conditioning members 70D, 70E. In the depicted embodiment, the fluid transfer device 40D is configured to deliver the air or other fluid through, past or in the vicinity of thermoelectric devices 50D, 50E or other temperature conditioning devices (e.g., heaters, other types of coolers, etc.) located upstream of the flow conditioning members 70D, 70E. In the illustrated arrangement, the same fluid transfer device 40D is sized and otherwise adapted to deliver the waste air from the thermoelectric devices 50D, 50E to the respective outlets 28. It will be appreciated that additional fluid transfer devices can be used to more air or other fluid to the flow conditioning members 70D, 70E and/or the outlets 28.

In FIG. 2B, a single fluid transfer device 40F is used to deliver air or other fluid to different portions of a single flow conditioning member 70F. As with other embodiments described and illustrated herein, the air or other fluid can be temperature-conditioned (e.g., cooled, heated) prior to being delivered to the flow conditioning member 70F using thermoelectric devices 50F, 50G and/or other cooling or heating apparatuses. Although the air or other fluid is shown to enter at different locations on the bottom of the flow conditioning member 70F, it will be appreciated that, for this and any other embodiments disclosed herein, the air or other fluid can feed the flow conditioning member 70F at any other location (e.g., side, top, etc.). Further, the waste air from each thermoelectric device 50F, 50G is conveyed to its own outlet 28. In other arrangements, such waste air stream can be combined into a common outlet header. Alternatively, as discussed herein, the bed 10F need not include a conduit to convey the waste air or fluid to an outlet using a distinct outlet.

In other embodiments, as discussed with reference to FIG. 15 herein, the bed construction can be used to facilitate the routing of waste fluid and/or conditioned fluid to its desired location. For example, the cushion member, the lower portion of the bed and/or any other component can be shaped or otherwise configured to channel or direct fluid to a desired location, either with or without the use of ducts or other channels.

Figure 2C:
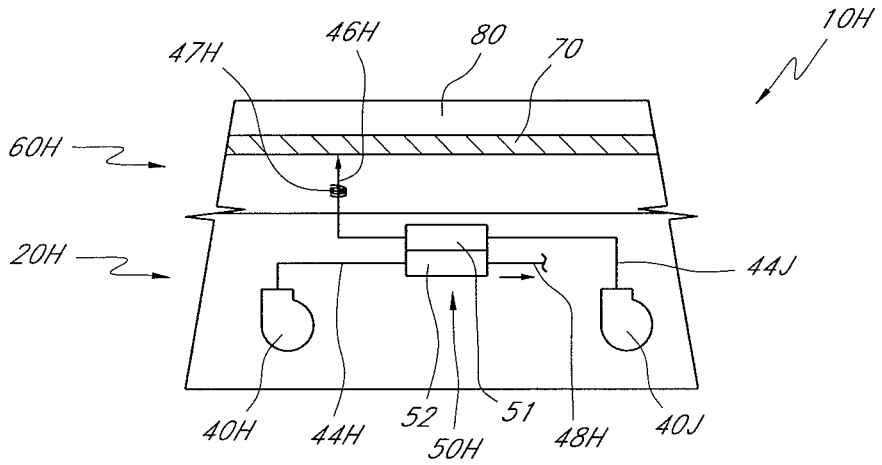
FIG. 2C illustrates a cross sectional schematic view of a climate controlled bed according to still another embodiment.

With reference to FIG. 2C, a climate controlled bed 10H can include separate fluid transfer devices 40H, 40J to deliver air or other fluid to the main heat exchanger 51 and the waste heat exchanger 52 of a thermoelectric device 50H. Therefore, as shown in FIG. 2C, one fluid transfer device 40J delivered thermally-conditioned air to the flow conditioning member 70, whereas a second fluid transfer device 40H delivers air to an outlet via a waste heat exchanger 52. Although only certain embodiments of a climate controlled bed using fluid transfer devices, thermoelectric devices, flow conditioning members and/or other components have been disclosed and illustrated herein, it will be appreciated that other variations of these configurations can also be used, as desired or required by a particular application.

Figure 3:
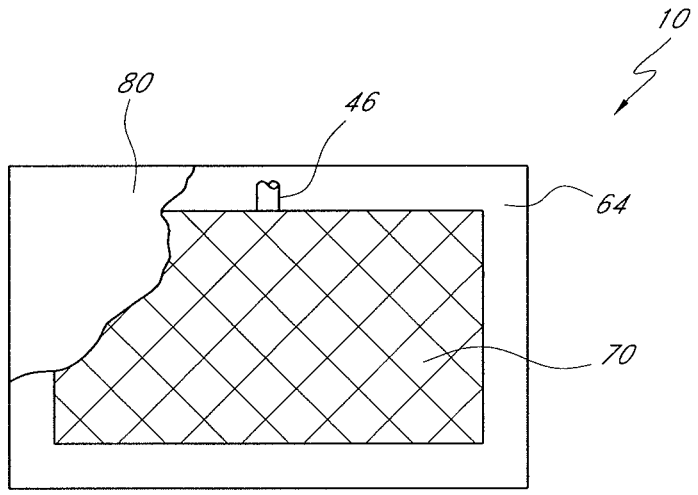
FIG. 3 illustrates a top view of a climate controlled bed according to one embodiment.

FIG. 3 illustrated a top view of at least a portion of a climate-controlled bed 10. For clarity, the vast majority of the top member 80 has been removed. As shown, the flow conditioning member 70 is generally positioned within a recessed area of the cushion member 64 or the like. Alternative, as discussed, the flow conditioning member 70 can be generally positioned along any surface of the cushion member 64, regardless of whether such a surface includes a recess or any other special shape or feature. For example, the flow conditioning member 70 can simply be placed along a substantially flat upper surface of the cushion member 64. Further, as discussed, the flow conditioning member 70 can be placed in fluid communication with one or more fluid transfer devices and/or thermoelectric devices. In the depicted embodiment, fluid flow is supplied to the flow conditioning member 70 using a single inlet conduit 46.

Figure 4:
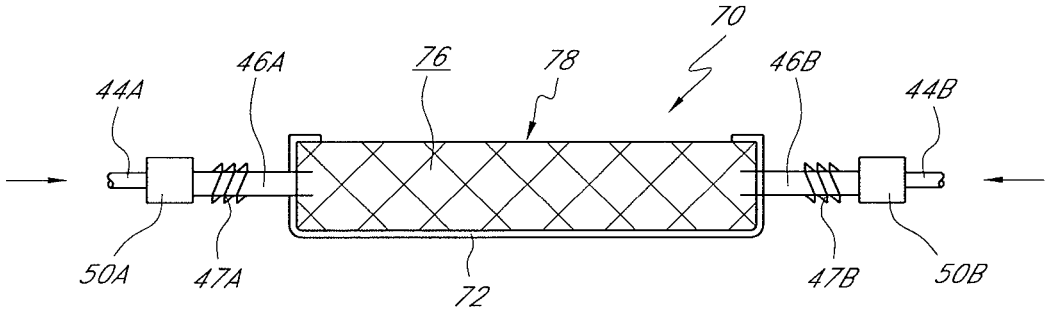
FIG. 4 illustrates a cross-section view of a flow conditioning member intended for use in a climate controlled bed according to one embodiment.

FIG. 4 shows a cross-section view of a flow conditioning member 70 which is in fluid communication with two sets of inlet conduits 46A, 46B and thermoelectric devices 50A, 50B. Thus, temperature conditioned (and/or ambient) air can be delivered to an interior portion 76 of the flow conditioning device 70 through one or both conduits 46A, 46B. As discussed, in other embodiments, more or fewer conduits can feed a particular flow conditioning member 70. As illustrated, the flow conditioning member 70 comprises an outer housing 72. The outer housing 72 can include one or more rigid, semi-rigid and/or flexible materials that are generally impermeable to air or other fluids. Thus, air entering the interior portion 76 can be conditioned (e.g., distributed generally evenly within the flow conditioning member 70) and be allowed to exit from an opening 78 located near the top of the member 70. Consequently, air can be advantageously targeted towards an occupant situated on the bed.

With continued reference to FIG. 4, the inlet conduits 46A, 46B connect to the interior portion 76 of the member 70 from opposite side surfaces of the outer housing 72. The conduits 46A, 46B, which as depicted are positioned downstream of respective thermoelectric devices 50A, 50B, comprise bellows 47A, 47B or other movable devices that are configured to accommodate for relative movement between the different sections or components of the climate-controlled bed (e.g., lower and upper portions).

Figure 5:
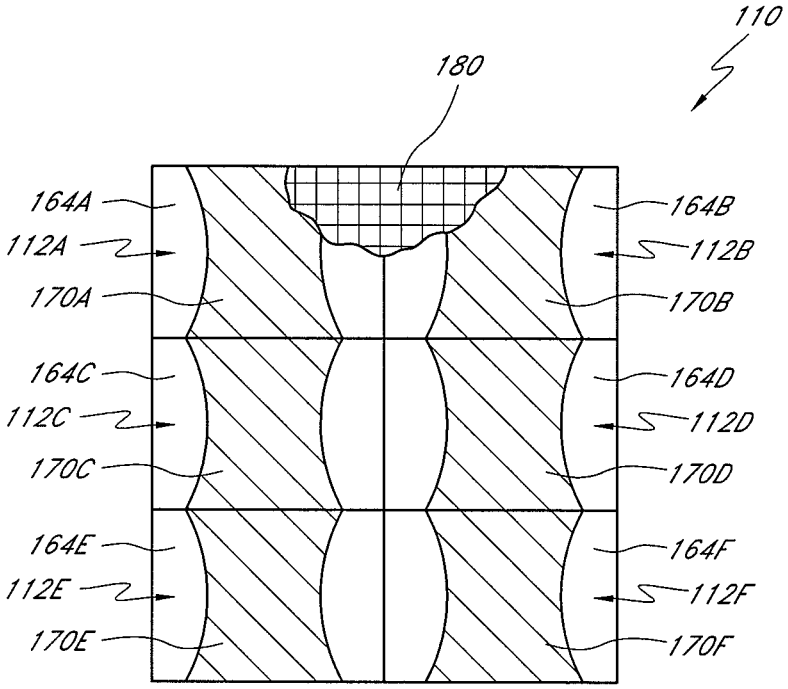
FIG. 5 illustrates a top view of a climate controlled bed with the vast majority of its top member removed in accordance with one embodiment.
Figure 6:
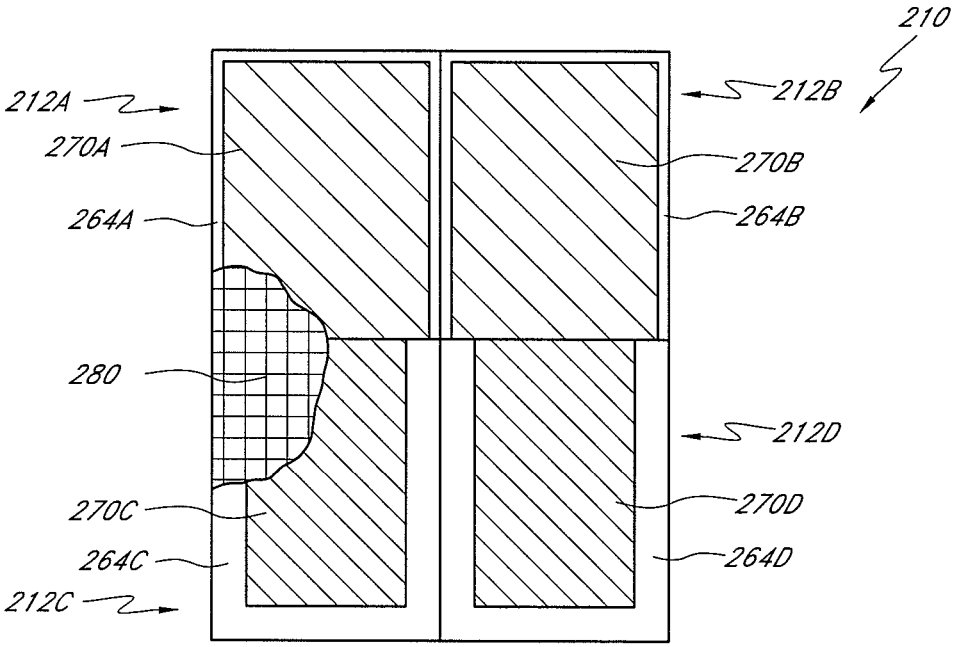
FIG. 6 illustrates a top view of a climate controlled bed with the vast majority of its top member removed in accordance with another embodiment.

FIGS. 5 and 6 illustrate two different embodiments of climate-controlled beds having distinct zones or sections. Such schemes can provide enhanced cooling and/or heating control to certain portions of the bed. Consequently, a user can customize a temperature-conditioning effect to his or her liking. For example, a user can choose to provide more or less cooling or heating to a particular zone or section. Further, such embodiments permit each occupant of a single bed to select a desired level of cooling and/or heating.

In FIG. 5, the illustrated bed 110 includes six different cooling and/or heating zones 112A-F. For clarity, the vast majority of a top member 180 has been removed to reveal the underlying flow conditioning members 170A-F. Each zone 112A-F includes its own flow conditioning member 170A-F. As discussed, each flow conditioning member 170A-F can be configured to receive conditioned (e.g., heated and/or cooled) or unconditioned (e.g., ambient) air or other fluid from one or more fluid transfer devices (not shown). In some embodiments, the air or other fluid delivered by the fluid transfer devices can be routed through, past or in the vicinity of one or more thermoelectric devices to selectively temperature condition the air or other fluid.

With continued reference to FIG. 5, the flow conditioning members 170A-F used in each zone 112A-F is substantially identical in size and shape. However, it will be appreciated that the shape, size, air distribution effect and/or characteristics of the flow conditioning members 170A-F used within a particular bed 110 can vary, as desired or required by a particular application. In FIG. 5, the flow conditioning members 170A-F are generally positioned where the bed's occupants are most likely to be situated. Thus, depending on the size of the bed, the number of occupants it is intended to hold and/or the like, the number, shape, size, spacing, location and other characteristics of the flow conditioning members 170A-F can vary.

The embodiment of the climate-controlled bed 210 illustrated in FIG. 6 includes only four cooling and/or heating zones 212A-D. As shown, each zone comprises a flow conditioning member 270A-D. However, unlike the flow conditioning members 170A-F discussed and illustrated with reference to FIG. 5, these flow conditioning members 270A-D vary from zone to zone. For example, the flow conditioning members 270A, 270B located in zones 212A, 212B on one end of the bed 210 are larger in surface area than the flow conditioning members 270C, 270D in the other two zones 212C, 212D. As discussed, such a scheme can be used when a higher volume of conditioned fluid is desired in selected zones (e.g., 212A and 212B). Flow conditioning members 270A, 270B that require additional volumetric flow and/or better temperature-conditioning abilities can be supplied by additional fluid transfer devices and/or thermoelectric devices.

Figure 7:
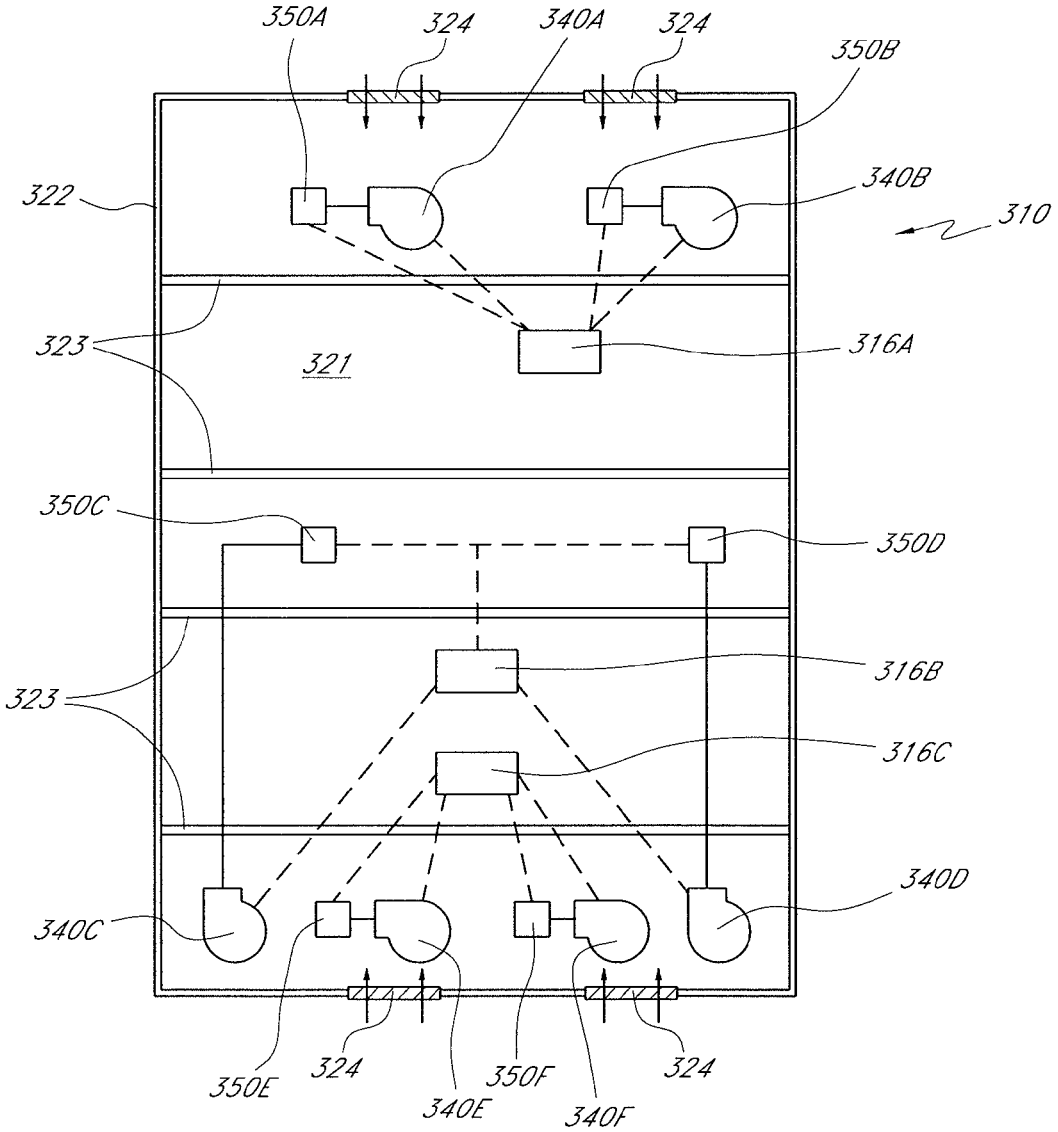
FIG. 7 illustrates a schematic top view of a lower portion of a climate controlled bed showing the various internal components of the temperature control system according to one embodiment.
Figure 8:
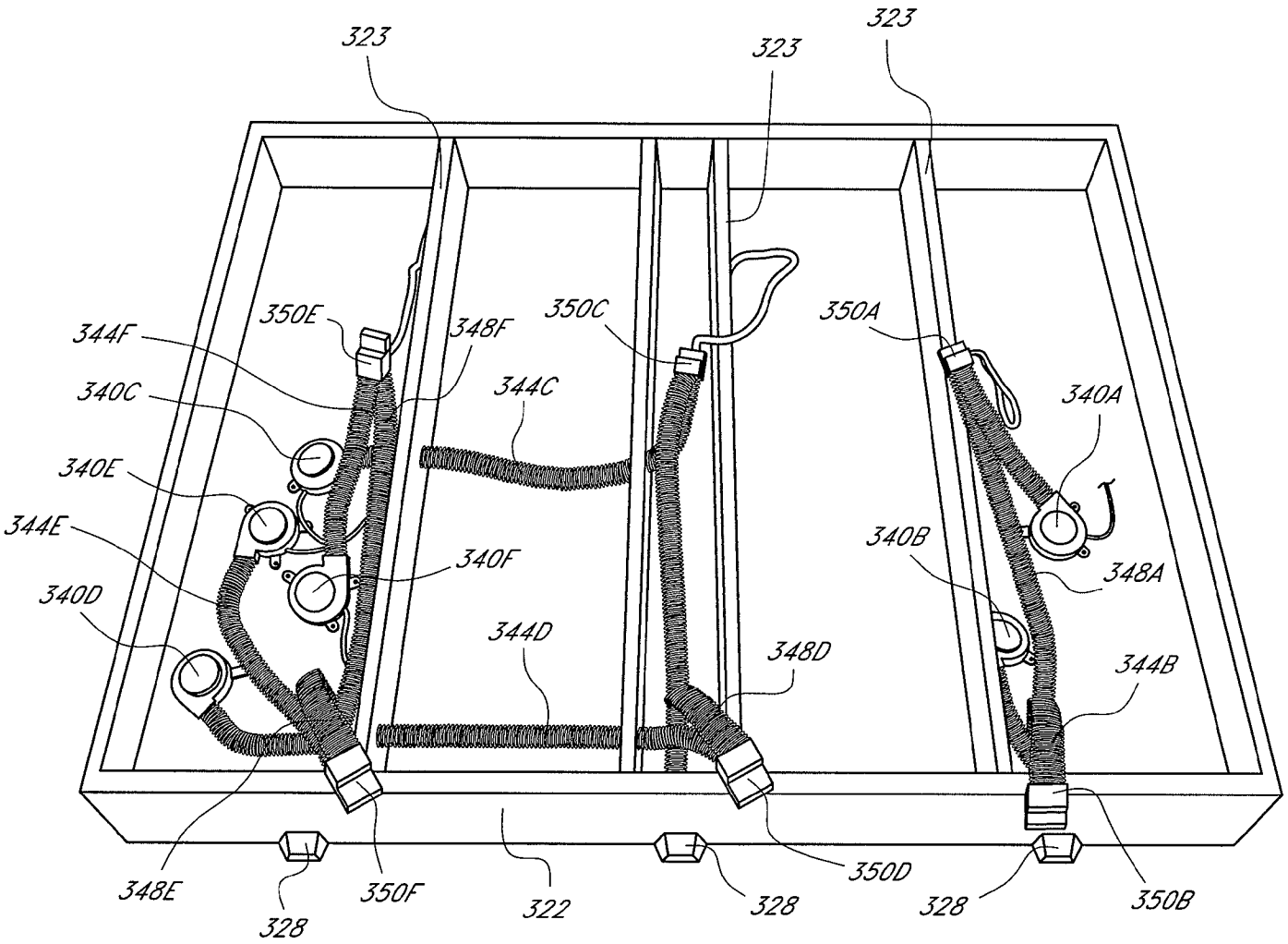
FIG. 8 illustrates a perspective view of a lower portion of a climate controlled bed similar to the embodiment schematically illustrated in FIG. 7.

FIGS. 7 and 8 illustrate the various components of a climate control system for a bed 310 according to one embodiment. For example, the top view of FIG. 7 depicts the frame 322 of the lower portion of a bed assembly 310. As illustrated, the frame 322 can include one or more interior struts or structural components 323 to provide additional strength and stability. Consequently, the fluid transfer devices 340A-F, the thermoelectric devices 350A-F, related control units or modules 316A-C and power, control and other electrical connections and/or other components or items must be accommodated within the interior space 321 or other location of the lower portion (e.g., frame member, box spring, etc.).

With continued reference to the top view of FIG. 7 and the corresponding perspective view of FIG. 8, it may be desirable to combine components of the climate control system within selected areas of the interior space 321 of the frame structure 322. For instance, in the illustrated embodiment, four fluid transfer devices (e.g., blowers, fans, etc.) 340C-F are positioned within a single partitioned region of the interior space 321, regardless of the location of the corresponding downstream thermoelectric device 350C-F. Consequently, hydraulic conduits, electrical wires and other connectors may need to traverse into various partitioned regions of the interior space 323. In some embodiments, struts and other partition member can include openings, slots, notches or other passageways through which such hydraulic, electrical and/or other types of connections may be routed. Further, one or more control units 316A-C that are used to regulate the function and operation of the climate control can be included within the frame structure 322.

Moreover, the frame structure 322 depicted in FIG. 7 and described herein preferably includes one or more inlets 324 through which ambient air may pass. As discussed, this ambient air can be transferred by the fluid transfer devices 340A-F past corresponding thermoelectric devices 350A-F for temperature conditioning (e.g., selectively heating and/or cooling). It will be appreciated that a frame structure of a climate-controlled bed can include more or fewer internal partitions, fluid transfer devices, thermoelectric devices, control units, electrical connections and/or the like.

Figure 9A:
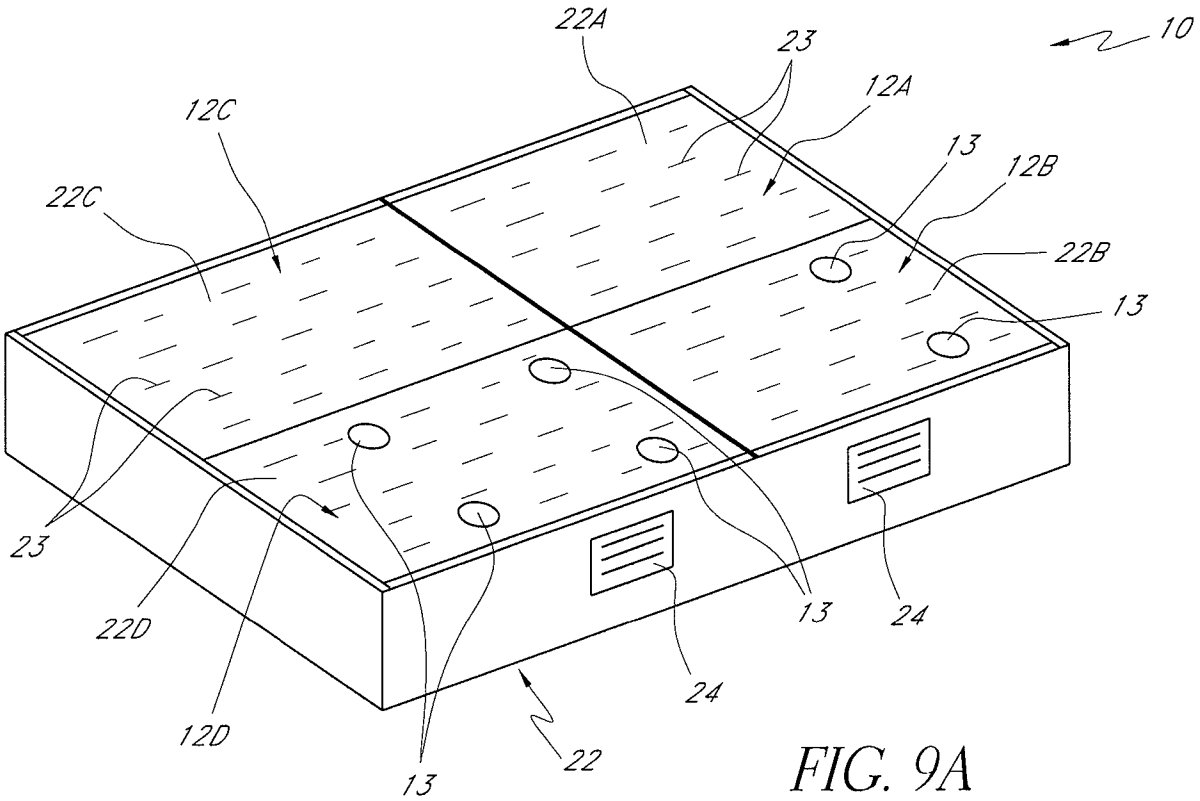
FIG. 9A illustrates a perspective view of a lower portion of a climate controlled bed according to another embodiment.

FIG. 9A illustrates yet another embodiment of a frame structure 22 for a climate controlled bed 10. The depicted frame structure 22 includes four top panels 22A-D or other members that are generally configured to enclose an interior portion of the structure 22. It will be appreciated that more or fewer top panels may be used depending on the particular circumstances involved (e.g., size of the bed, materials of construction, etc.). As discussed with respect to other embodiments herein, the interior space of a frame structure 22 can be configured to house, and thus conceal, one or more fluid transfer devices, thermoelectric devices and/or other components of the bed's climate control system. Therefore, the top panels 22A-D in the illustrated embodiment can be provided with one or more openings 13 situated along desired locations to permit access from the interior space of the frame structure 22 to the flow conditioning members and/or other components that may be positioned on top of the frame structure 22. For example, conduit conveying air or other fluid from a fluid transfer device can be routed through an opening 13 in the panels 22A-D. The exact quantity, size, shape, spacing and other details of the openings 13 can be varied to suit a particular situation.

With continued reference to FIG. 9A, the top panels 22A-D or other covering of the frame structure 22 can include a plurality of anti-skid member 23 that are configured to prevent or reduce the likelihood that an upper portion (not shown) positioned above the frame structure 22 will move relative to the frame structure 22 during normal operation of the climate-controlled bed assembly. The anti-skid members 23 can include any of a variety of protruding and/or recessed features, such as, for example, bumps, dimples and/or the like. The number of anti-skid members 23, their size, shape, density, spacing, location, material of construction, the method by which the anti-skid members 23 are attached to the top panels and/or other characteristics of the anti-skid members 23 can vary.

Figure 9B:
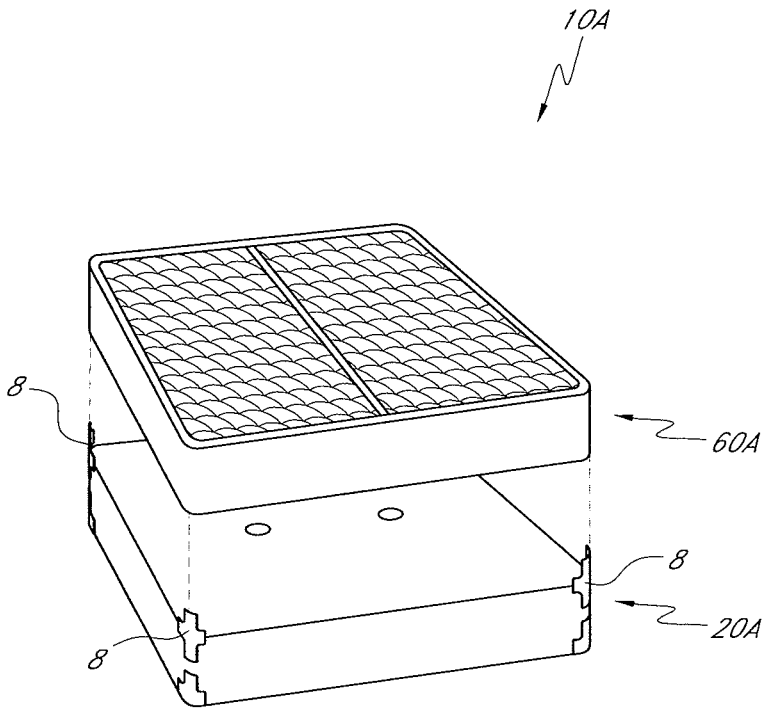
FIG. 9B illustrates an exploded perspective view of a climate controlled bed according to another embodiment.

FIG. 9B illustrates another method to maintain the upper portion 60A of a climate controlled bed 10A from undesirably moving (e.g., sliding, slipping, etc.) relative to the lower portion 20A. As shown, guides 8 can be used to properly align the upper and lower portions 60A, 20A relative to one another. In some embodiments, the guides are situated at each corner of the bed 10A. The guides 8 can comprise one or more rigid and/or semi-rigid materials, such as, for example, plastic, fiberglass, steel or other metals, wood, etc. The guides 8 are preferably capable of adequately attaching to the lower portion 20A and/or the upper portion 60A and resisting any forces, moments and/or other stresses that can develop during the bed's use.

Figure 9C:
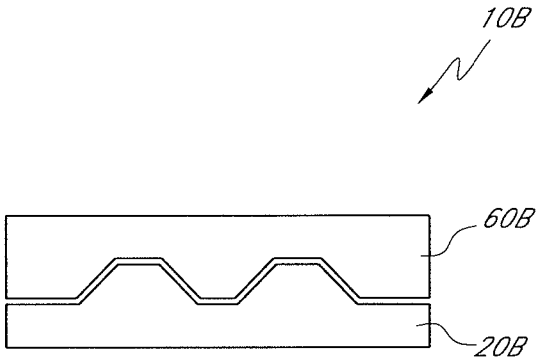
FIG. 9C illustrates an elevation view of a climate controlled bed according to one embodiment.

FIG. 9C illustrates one embodiment of an upper portion 60B and a lower portion 20B that have been configured to cooperate with each other so as to prevent relative movement between the two. In the depicted embodiment, the upper and lower portions 60B, 20B include appropriately shaped adjacent surfaces that are configured to substantially interlock with one another. It will be appreciated that the illustrated shape is merely one example of such an interlocking design, and that any other generally interlocking pattern can be used. In addition, such interlocking configuration can be used to secure two or more adjacent layers or components of the bed relative to one another, even where such layers or components are located within a single portion 20B, 60B of the bed. The generally interlocking design illustrated in FIG. 9C is particularly well-suited for full foam or latex mattresses, as locks can be molded or otherwise formed within the adjacent portions. For example, in FIG. 9C, the upper portion 60B can comprise a foam cushion member, while the lower portion 20B can comprise a foundation member.

In any of the embodiments illustrated herein, such as, for example, the climate controlled beds shown in FIGS. 9A through 9C, the climate controlled bed can comprise legs or other support members to provide additional clearance between the bottom of the lower portion and the floor on which the bed is positioned. This can also help permit fluid inlets or other openings to be discretely positioned on a bottom surface of the lower portion.

Figure 10:
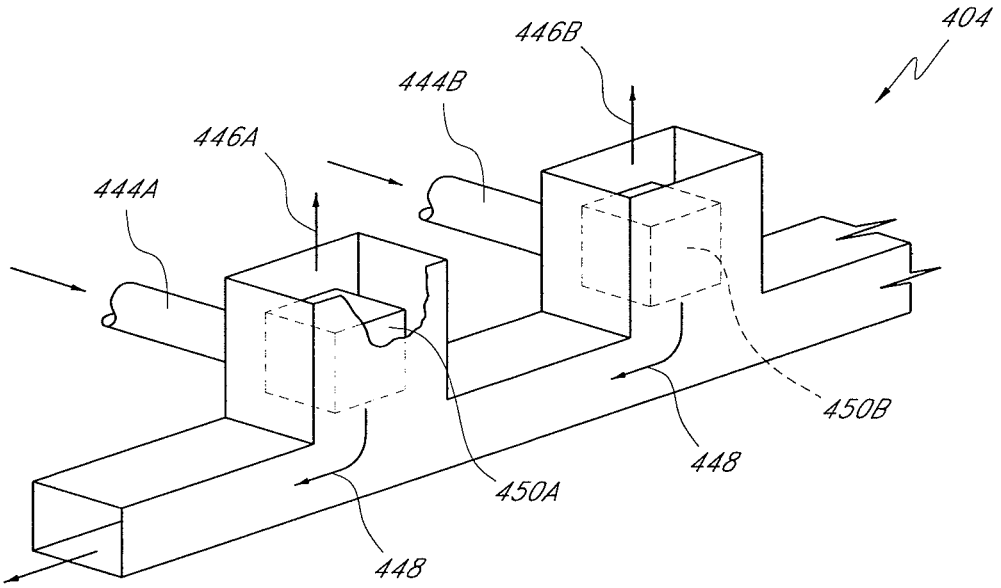
FIG. 10 illustrates a perspective view of a combined fluid module for use in a climate controlled bed in accordance with one embodiment.

With reference to FIG. 10, a climate-controlled bed can comprise a combined flow diversion member 404 that is capable of directing fluid passing through the main heat exchanger portion of a thermoelectric device 450A, 450B in one direction 446A, 446B (e.g., toward flow conditioning members or other components of the upper portion of a climate-controlled bed assembly), while collecting the directing fluid passing through the waste heat exchanger portion of the device in a different direction 448 (e.g., towards an outlet). In some embodiments, the thermoelectric devices 450A, 450B can be encased in foam. Further, a portion or the entire combined flow diversion member 404 comprise foam. Such an embodiment can help reduce the number of separate fluid conduits and other components that a climate-controlled bed includes.

Figure 11A:
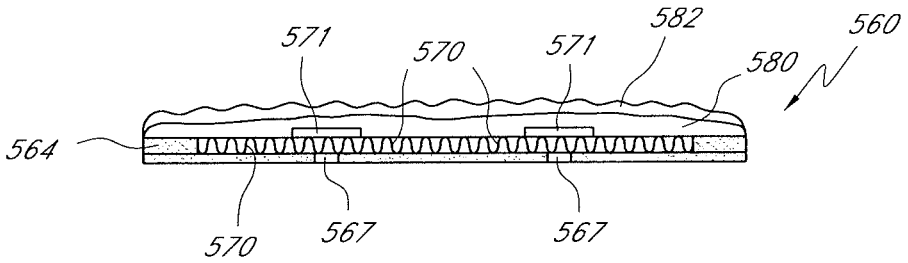
FIGS. 11A and 11B illustrate cross-sectional and perspective views, respectively, of a climate controlled bed according to one embodiment.
Figure 11B:
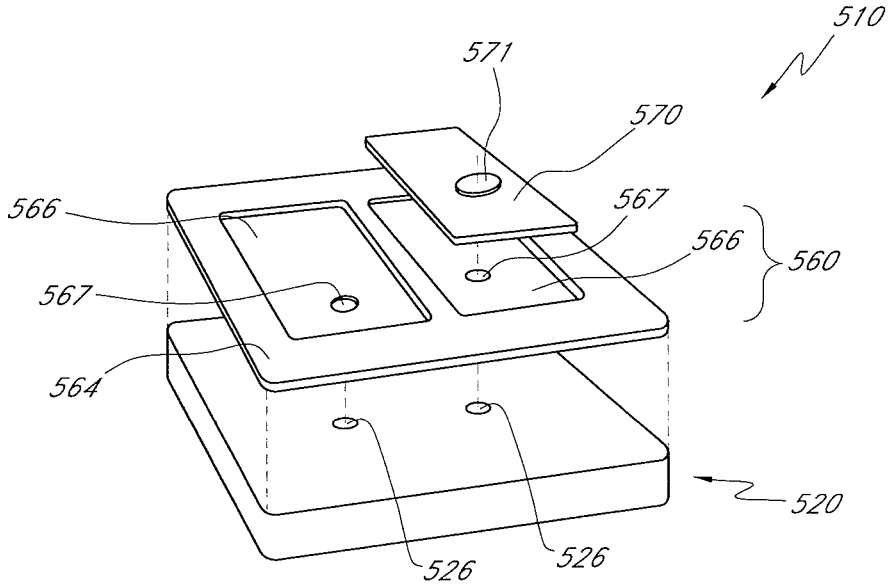

FIGS. 11A and 11B illustrate one embodiment of an upper portion 560 of a climate controlled bed 510. Air or other fluid is routed from the lower portion 520 towards the upper portion along one or more areas. For example, in the illustrated arrangement, air flow is provided from the lower portion 520 along two or more different centerlines of the bed 510. These centerlines can be located generally along the areas of the bed where occupants are expected to be situated. The top surface of the lower portion 520 can comprise openings 526 through which fluid conduits (not shown) can be routed. As discussed herein with respect to other embodiments, fluid transfer devices can be used to deliver temperature-conditioned and/or ambient air from the lower portion 520 and/or any other portion of the bed 510 toward the upper portion 560.

With further reference to FIGS. 11A and 11B, the upper portion 560 can include a bottom cushion member 564 that includes one or more recessed areas 566. The recessed areas 566 preferably include openings 567 that are sized, shaped, located and otherwise designed to generally align with the underlying opening 526 in the lower portion 520. Thus, the fluid transfer devices can be effectively placed in fluid communication with the recessed areas 566 of the cushion members 564 and anything situated therein.

As shown in the cross-section view of FIG. 11A, a flow conditioning member 570 can be placed within the recessed areas 566 of the cushion members 564. Alternatively, as discussed, the flow conditioning member 570 can be positioned along a non-recessed area 566 of the cushion member 564. For example, the cushion member 564 need not include a recessed area 566 at all. Thus, the flow conditioning member 570 can be placed on a generally flat (or otherwise shaped) upper surface of the cushion member 564. Any one or more of the various embodiments of the flow conditioning members described and/or illustrated herein can be used. For example, the flow conditioning member 570 can comprise a spacer fabric, a porous structure or other component and/or the like. In some embodiments, as described in greater detail herein, the flow conditioning member 570 includes a spacer fabric or another porous material (e.g., air permeable foam) placed completely or partially within a bag and/or another type of partial or complete enclosure.

In order to assist in better distributing air or fluid flow that enters the flow conditioning members 570 situated within the recessed areas 566 of the upper portion 560, a flow diverter 571 can be placed on the top surface of one or more flow conditioning members 570, as shown in FIGS. 11A and 11B.

The use of diverters can be used to provide a more uniform distribution of the fluid to the occupant due to the fact that conditioned fluid may appear to originate in a single spot. Such diverters can be configured to move the fluid laterally through one or more distribution layers. The use of diverters 571 can be used to provide a more uniform distribution of the air or other fluid being delivered to an occupant. By strategically positioning such diverters 571 in the vicinity where air flow enters the recessed area of the cushion member 564, air is spread laterally throughout the corresponding flow conditioning or distribution members 570.

As discussed, the flow conditioning member 570 can comprise a spacer fabric/fluid distribution bag combination that is inlaid into another filler material. However, a spacer fabric or other similar flow distribution or flow conditioning member can be used with any of the embodiments of a climate controlled bed disclosed herein without the use of a bag or other enclosure. In some embodiments, if the bag/fabric member is undersized, the occupant may not realize adequate distribution coverage. The bag or other enclosure can comprise a plurality of openings through which air or other fluid can exit. In some embodiments, the use of a bag can help serve as a diverter to provide more enhanced distribution of air or other fluid within a spacer fabric or other flow conditioning member. In addition, the inlaid spacer fabric or other flow conditioning member 570 can include edges that are generally sealed in order to reduce or prevent lateral airflow to selected areas. Alternatively, if the filler layer includes non-porous areas, such sealed edges or other features may not be required.

With continued reference to FIGS. 11A and 11B, one or more topper members or layers 580, 582 can be positioned above the cushion member 564 and the flow conditioning members 570 to further enhance comfort and/or safety. For example, in some embodiments, the lower topper layer 580 can be configured to distribute air generally in a lateral direction and the upper topper layer 582 can be configured to distribute air in a vertical direction (e.g., toward an occupant). It will be appreciated, however, that more or fewer topper layers can be included in a particular bed assembly. In addition, the topper layers can be configured to distribute or otherwise flow condition air differently than discussed herein. For example, one or more of the layers can be configured to distribute air both vertically and laterally.

Figure 12A:
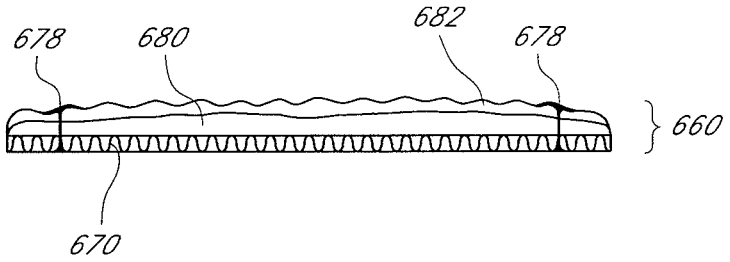
FIGS. 12A and 12B illustrate cross-sectional and perspective views, respectively, of a climate controlled bed according to another embodiment.
Figure 12B:
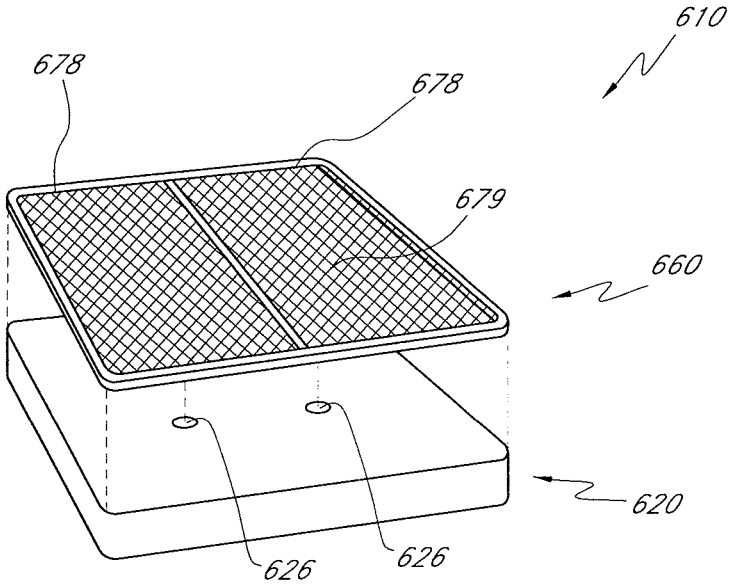

Another embodiment of an upper portion 660 for use in a climate-controlled bed 610 is illustrated in FIGS. 12A and 12B. As shown, a spacer fabric or other flow conditioning member 670 can be positioned above the lower portion 620 of the bed 610. Such a flow conditioning member 670 can be sized and shaped to extend across some or all of the top surface area of the lower portion 620 (e.g., frame structure, box springs, etc.). As with other embodiments, one or more top layers 680, 682 can be provided above the flow conditioning member 670 to enhance the comfort and safety of the upper portion 660.

With continued reference to FIGS. 12A and 12B, in some embodiments stitching, laminations and/or the like can be used to improve fluid flow through the flow conditioning member 670 and other portions of the upper portion 660. For example, engineered stitching 678 can be provided along the perimeter and/or any other area of the upper portion 660 to better control the flow of air or other fluid within the flow conditioning member 670 and other components of the upper portion 660. In some arrangements, the system relies on the use of particular stitching patterns, diameters, needle sizes, thread diameters and/or other features in the upper portion 660 to control the flow of conditioned and/or unconditioned fluids therethrough. In some embodiments, it may not be desirable for fluids to cross the center of the upper portion 660 (e.g., topper and/or flow conditioning members). This can help isolate different cooling and/or heating zones so that the temperature conditioning for a particular climate-controlled bed 610 can be customized as desired by one or more occupants. The use of an engineered stitch can help prevent fluids in different zones from interacting with each other, thereby providing individualized control of the heating and/or cooling features of the bed 610 or similar device.

Stitching can also be used to control unwanted lateral flow of fluids. For example, stitches can be added around the perimeter of the device to prevent the fluid from moving outside one or more desired conditioned areas. The use of the proper stitching compression, patterns and/or other features can help provide a path for the fluid (e.g., air) to flow toward one or more occupants. The size of the stitching and the density of the stitches can be modified or otherwise controlled to provide even fluid distribution to an occupant. Thus, by using even only a single sheet of spacer fabric and controlling the flow of fluid using stitching, lamination and/or other systems, a more cost effective upper portion 660 or topper assembly can be realized. Accordingly, engineered stitching and/or other similar features can allow for improved fluid flow while enhancing the comfort level for an occupant.

As described in the various embodiments herein, climate-controlled beds require some means of moving air or other fluid through the top surface of the bed (or similar assembly) in the direction of one or more occupants. However, it should be appreciated that beds constructed of solid or substantially solid cores may require alternative solutions. This is especially important since solid core beds are becoming increasingly more popular. As discussed herein, the solid cores of such bed assemblies can be to channel fluids for improved distribution toward an occupant and/or to channel waste air or fluid away from a climate controlled bed assembly.

Figure 13:
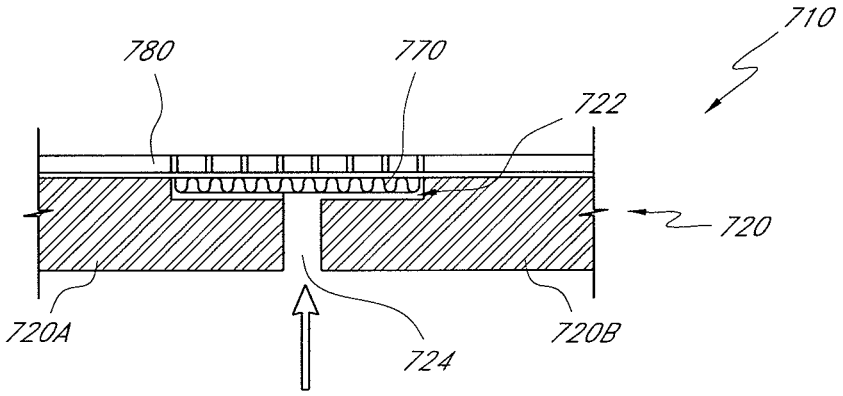
FIG. 13 illustrates a cross-sectional view of a climate controlled bed according to yet another embodiment.

The cross-sectional view of FIG. 13 illustrates a pocket or channel 724 that has been strategically formed through the solid core 720 of a bed 710. In some embodiments, the pocket or channel 724 can been formed during the manufacture of the solid core 720. Alternatively, the pocket or channel 724 can be cut out of the core or otherwise created after the solid core 720 has been manufactured. In yet other embodiments, the pocket or channel 724 can simply exist where adjacent sections 720A, 720B of the core 720 meet. Further, as illustrated in FIG. 13, the top surface of the core 720 can include a recess 722 or similar feature. Thus, the recessed area 722 can be configured to receive an appropriately sized and shaped flow conditioning member 770. Accordingly, air or other fluid entering the pocket or channel 724 can enter the flow conditioning member 770 and be distributed along the flow conditioning member's top surface in the direction of an occupant. As with other embodiments discussed and illustrated herein, one or more topper members 780 can be placed on top the core 720 and the flow conditioning member 770 to provide the desired level of comfort.

Figure 14A:
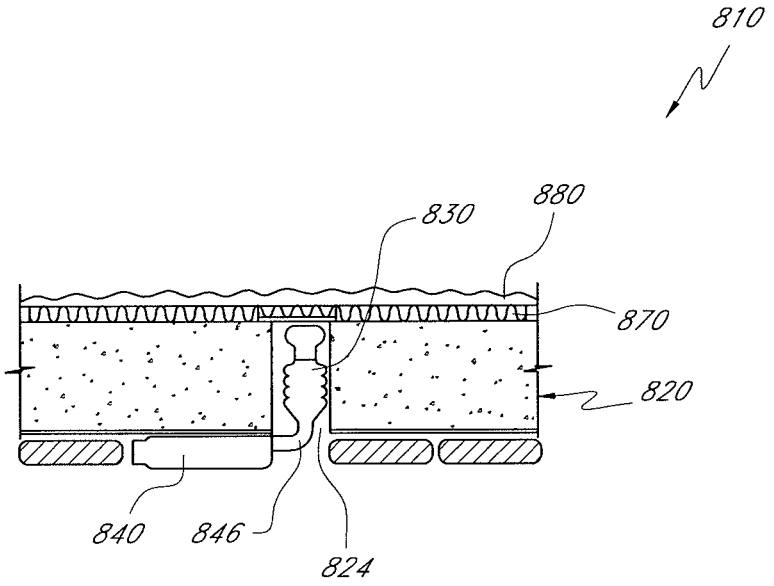
FIGS. 14A and 14B illustrate cross-sectional views of climate control systems having bellows or similar devices for use in beds in accordance with one embodiment.
Figure 14B:
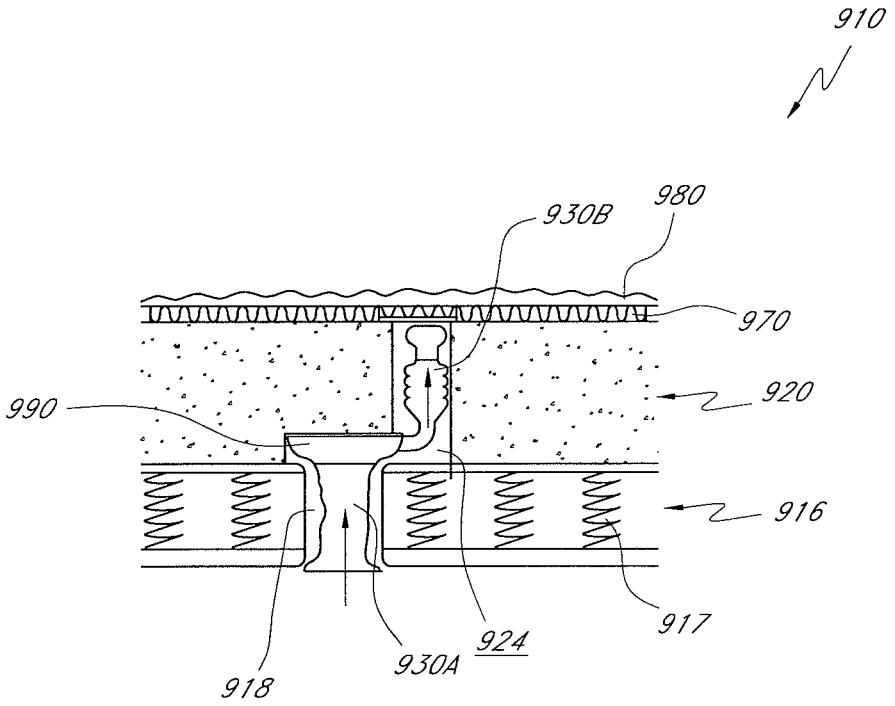

As illustrated in FIGS. 14A and 14B and discussed in relation to other embodiments, herein, in order to accommodate for the vertical translation of a climate-controlled bed assembly, bellows 830, 930 or other movable members can be used to provide the desired flexibility and/or insulation properties. It may be desirable to account for the movement of certain components of the bed and/or for the relative movement between adjacent bed components in order to protect fluid conduits, fluid transfer devices and/or other items that comprise the climate control system.

In FIG. 14A, the climate-controlled bed 810 includes a cushion member 820 that is configured to compress and/or decompress in response to changing load conditions. In addition, in the depicted embodiment, a fluid transfer device 840 is positioned directly underneath the cushion member 820. Thus, in order to allow the fluid conduit 846 that delivers fluid from the transfer device 840 (e.g., blower, fan, etc.) to the flow conditioning member 870 at the top surface of the bed 810, bellows 830 or some other deformable device can be provided.

Likewise, as illustrated in FIG. 14B, two or more bellows 930A, 930B or similar deformable devices can be included along various portions of the fluid delivery network. The illustrated embodiment of a climate-controlled bed 910 comprises a lower portion 916 having springs (e.g., box spring, mattress with springs, etc.). A cushion member 920 is positioned generally above the lower portion 916. Therefore, under such an arrangement, both the lower portion 916 and the upper portion 920 are capable of movement. Accordingly, bellows 930A, 930B can be used on fluid conduits in both the lower portion 916 and upper portion 920. In some embodiments, the bellows can be configured to allow for vertical, horizontal and/or torsional shifting of the various components of the climate-controlled bed 910, while still permitting the system to deliver conditioned and/or unconditioned air or other fluid towards an occupant. Where the channels in the upper and lower portions are not aligned, as is the case in the embodiment illustrated in FIG. 14B, a notch 990 or other transition area formed within the upper and/or lower portions can be used to maintain a continuous fluid delivery path through the entire depth of the bed 910.

One important consideration associated with moving fluids within an air conditioned bed is accommodating fluid intakes and exhausts. Thus, in some embodiments of the devices and systems illustrated and disclosed herein, the fluid delivery system advantageously includes an efficient means of receiving fluids from the surrounding environment and delivering them to the bed or other seating assembly.

In some embodiments, it may be desirable for the fluid intake to be located in an area that reduces noise or other occupant discomfort. Further, the intake can be isolated from other undesirable fluids that may enter the fluid distribution system. In one embodiment, one or more ducts can be used to reduce such undesirable contamination or mixing. However, it should be appreciated that the use of ducts can generally increase the cost, complexity, possibly failure modes and the likelihood of other undesirable occurrences, as they may become detached or otherwise become compromised.

Figure 15:
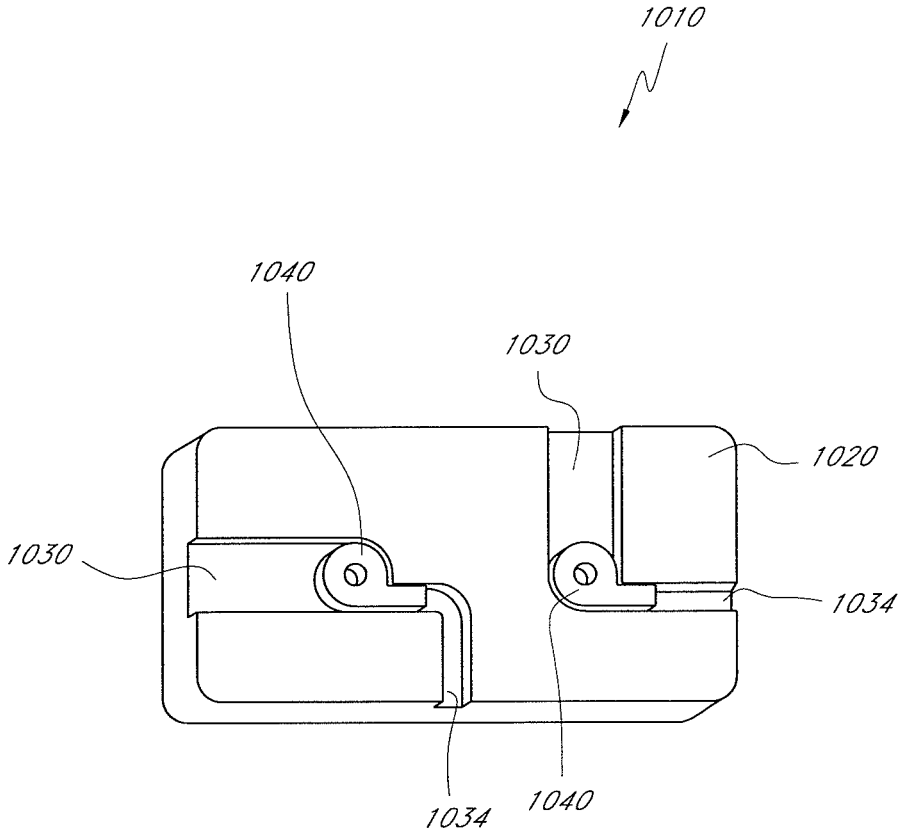
FIG. 15 illustrates a rear perspective view of a cushion member having embedded channels for delivering fluid to and from fluid transfer devices in accordance with one embodiment.

In some embodiments, as shown in FIG. 15, the use of channels or other distribution networks can be formed (e.g., molded, tooled, cut, etc.) on the underside 1020B of a cushion member 1020 or other component of a climate-controlled bed assembly 1010. This can help allow some, most or all of the fluid distribution system (e.g., intake and/or distribution/waste fluid channels 1030, 1034) to be incorporated into the structure of a cushion member 1020 and/or the like. Thus, such designs are particularly well suited where a bed platform is utilized (e.g., no box spring). However, in other embodiments, one or more separate parts that provide for the mounting and fluid intake/exhaust can be included. In some embodiments, a "platform" which is separate from the cushion material 1020 can be used. For example, in one arrangement, such a platform can be approximately 2 inches thick. In other embodiments, however, the platform can include a different size, dimensions, shape and/or other configuration. This platform can be advantageously configured to facilitate mounting and fluid distribution. In some embodiments, the system can comprise one or more openings in the cushion material 1020 (e.g., holes through the center of the mattress) and a fluid distribution system as described herein.

Further, it may be desirable to reduce the level of noise generated by the fluid transfer device (e.g., fan, blower, combination fan/TED device, etc.). For example, the noise reduction can help make the environment more conducive for sleeping or resting. Foam or other sound reducing materials can be used as liners on the inside of the bed skirt or other components of a climate-controlled bed assembly to help reduce the sound that originates from within or under the bed.

In addition, as beds are presently being constructed using a number of new techniques, it is important to provide air conditioned bed components or stand-alone toppers that are capable of integrating with such new designs and making use of their inherent advantages.

Figure 16A:
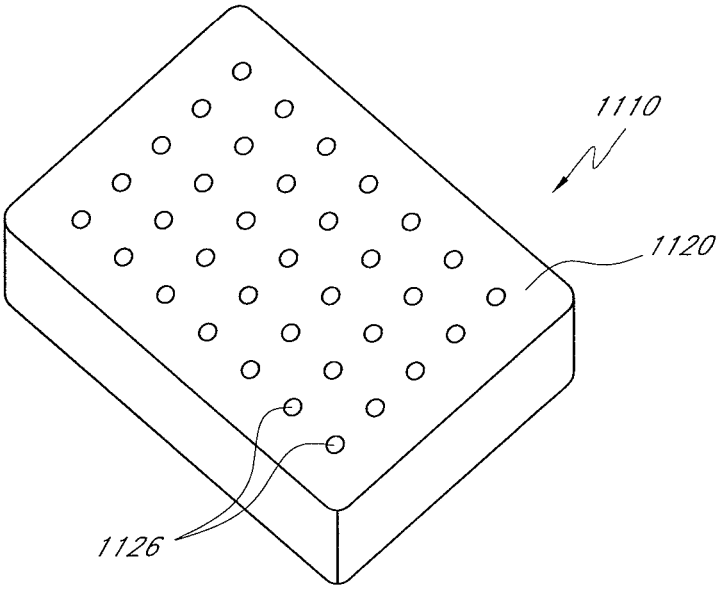
FIGS. 16A and 16B illustrate top perspective and cross-sectional views, respectively, of a climate controlled bed according to still another embodiment.
Figure 16B:
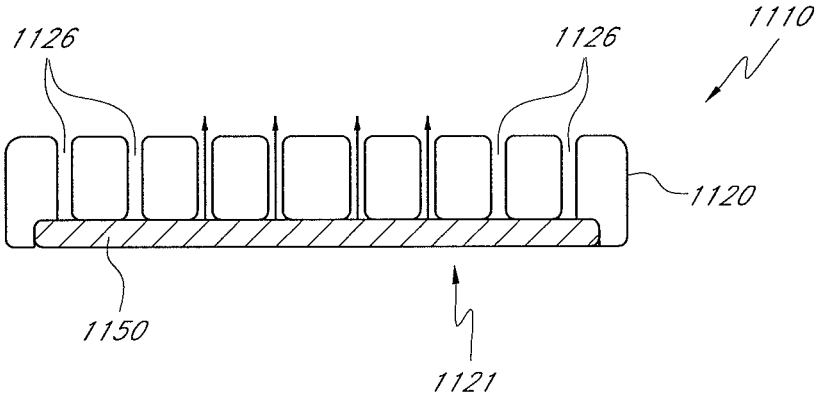

Another embodiment of a climate-controlled bed assembly is illustrated in FIGS. 16A and 16B. The cushion material (e.g., mattress) of the depicted bed 1110 can comprise Latex or similar resilient materials. Such materials are becoming increasingly more popular with bed manufacturers because they eliminate the need for spring products while still maintaining a desired level of resiliency. Mattresses and other cushion materials 1120 manufactured from such materials can comprise a plurality of holes or other openings 1126. In the illustrated embodiment, a flow conditioning member 1150 (e.g., a spacer) is configured for placement on the underside 1121 of the mattress or other cushion material 1120. Therefore, the mattress or other cushion material 1120 can comprise a recess or other similar feature configured to receive an appropriately shaped and sized flow conditioning member 1150. As air or other fluid flows through the is distributed the flow conditioning member 1150 in enters the plurality of opening 1126 located within the body of the cushion material 1120 and is conveyed toward an occupant. Therefore, as has been illustrated through the various embodiments disclosed in the present application, flow conditioning member can be placed in the top and/or bottom surfaces of a cushion member or similar component of a climate-controlled bed assembly.

The various embodiments described herein can include one or more control strategies or features to further enhance the operation and function of the climate-controlled bed assembly. For example, the bed can include a control system that is configured to regulate the air temperature and/or velocity of the temperature-conditioned fluid. In some embodiments, this can be accomplished by modifying the speed of a fluid transfer device (e.g., fan, blower, etc.) and/or varying the direction and/or magnitude of electrical current being delivered to the system's thermoelectric devices. Accordingly, the climate controlled bed can include one or more control schemes which regulate the operation of the various components of the climate control system. In some embodiments, the climate control system can be incorporated into the climate controlled bed assembly (e.g., either directly on the bed, via a separate controller and/or the like).

With continued reference to the system's control features, the climate-controlled bed assembly can be configured to measure and record the temperatures at one or more locations or of one or more system components. Such data can be advantageously incorporated into a control scheme. For example, the temperature at or near the surface of the bed (e.g., the temperature which most accurately assesses what an occupant feels) can be measured and provided to a control module for display, automatic temperature adjustment and/or the like. Further, the control components of the system can be in the form of a closed loop.

In some embodiments, a wand or some other type of remote controller can be used for occupant interaction. For example, the temperature at or near the surface of the bed can be displayed on the wand. Additional control capabilities, such as, for example, temperature adjustment, mode selection, ON/OFF, etc., can also be included. For instance, the wand can permit a user to select "SLEEP" mode wherein the temperature and volume of air being conditioned and delivered toward the occupant is adjusted according to that occupant's desired sleep environment and/or ambient conditions. In one arrangement, the climate-controlled bed can include a thermal alarm that helps to adjust (e.g., increase, decrease) temperatures at or near the surface of the bed to generally coincide with biological increase or other changes in an occupant's body temperature at or near the end of the sleep cycle.

In addition, as discussed herein with respect to certain embodiments, the bed can also comprise various heating and/or cooling zones to allow an occupant to customize the temperature and feel at various portions of the bed. Further, such a feature allows each occupant using a single bed to select a desired operational mode. Further, the bed can include one or more power supplies (e.g., AC outlet, DC power, such as a rechargeable battery, etc.). Such power supply modules and components can be discretely positioned on or within selected areas of the bed assembly.

With continued reference to the bed's climate control system, it will be appreciated that the devices, systems and methods described herein can be used in conjunction with other devices, systems and methods to further enhance the effectiveness of heating and/or cooling. For example, the beds can comprise a sterling pump. Further, the bed can be configured to utilize advantages related to the use of phase change materials and the use of water towards temperature control. Moreover, as discussed, thermally conditioned air or other fluid can be directed to selected areas of the bed, such as, for example, the pillow, lower back, legs, etc. For instance, an occupant can choose to provide relatively cool air to his or her head, while providing warmer air to his or her feet.

The effectiveness of the bed's climate control system can be further enhanced by returning temperature conditioned air back to the fluid transfer device. In addition, the in some embodiments, a thermistor can be positioned within or on one or more topper members, cushion members and/or other components of the climate-controlled bed. In alternative embodiments, a thermistor can be positioned generally next to an occupant, such as, for example, near the occupant's side, head, foot, pillow and/or the like.

In some embodiments, the climate-controlled bed assembly can comprise a radio alarm that can be configured to work in conjunction with a thermal alarm to turn on and/or off at particular times. As with other operational features, this can be customized by an occupant to his or her preference.

The flow conditioning members, such as inserts, can include liners and/or coating for enhanced protection against moisture or other substances, for enhanced air impermeability (where desired) and/or the like. The use of certain coatings, linings, materials and/or the like can help reduce thermal losses while the conditioned air is being transferred within the climate control system. Further, the use of separate liners can facilitate the manufacture, assembly, repair, maintenance and/or other activities related to climate-controlled bed assemblies. In addition, according to some embodiments, some or all of the channels, recesses and other features in the bed assembly can be advantageously molded at the time the respective component is being manufactured. Alternatively, these features can be cut-out or otherwise shaped after the respective items are constructed.

In addition, in order to prevent damage to the internal components of the climate control system (e.g., fluid transfer device, thermoelectric device, conduits, flow conditioning members, etc.) and to enhance the quality of the air being used to selectively heat and/or cool the bed, one or more intake filters can be positioned upstream of the fluid inlet into the climate control system. According to some arrangements, the filter comprises a dust cover or a similar device. In some embodiments, such filters can be scented to provide a more pleasant environment for the bed's occupant.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while the number of variations of the inventions have been shown and described in detail, other modifications, which are within the scope of these inventions, will be readily apparent to those of skill in the art based upon this disclosure. It is also contemplated that various combinations or subcombinations of the specific features and aspects of the embodiments may be made and still fall within the scope of the inventions. Accordingly, it should be understood that various features and aspects of the disclosed embodiments can be combined with, or substituted for, one another in order to perform varying modes of the disclosed inventions. Thus, it is intended that the scope of the present inventions herein disclosed should not be limited by the particular disclosed embodiments described above, but should be determined only by a fair reading of the claims.

What is claimed is:

1. A climate controlled assembly for placement on a bed, the assembly comprising:

a flow conditioning member comprising a spacer material configured to distribute air at least partially through the flow conditioning member, wherein the flow conditioning member comprises at least one resilient material that is rigid or semi-rigid, the flow conditioning member comprising a porous, intricate internal structure;

wherein the flow conditioning member comprises stitching to control a flow of fluid within the flow conditioning member, wherein the stitching is configured to help prevent the passage of fluids across the stitching within the flow conditioning member;

wherein the stitching passes through the spacer material and is used to provide a path for fluid flow within the flow conditioning member, and wherein the stitching helps to fluidly separate fluids passing through spacer material located in adjacent flow conditioning members; and wherein the flow conditioning member and the cushion member of the bed on which the flow conditioning member is positioned are separate and not attached to one another; and a fluid transfer device in fluid communication with the flow conditioning member via at least one fluid conduit, the fluid transfer device configured to selectively deliver fluid to the flow conditioning member.

2. The climate controlled assembly of claim 1, further comprising an enclosure, the enclosure at least partially surrounding the flow conditioning member, wherein the enclosure comprises a plurality of openings through which fluid passing through the flow conditioning member exits.

3. The climate controlled assembly of claim 2, wherein the enclosure comprises a bag.

4. The climate controlled assembly of claim 1, further comprising at least one thermoelectric device, wherein fluid transferred by the fluid transfer device passes through or past a thermoelectric device to thermally condition such fluid before it enters the flow conditioning member.

5. The climate controlled assembly of claim 4, wherein the at least one thermoelectric device is configured to selectively heat or cool fluids being delivered to the flow conditioning member.

6. The climate controlled assembly of claim 1, further comprising at least one layer positioned above the flow conditioning member to enhance comfort.

7. The climate controlled assembly of claim 1, wherein the flow conditioning member comprises at least one non-porous area.

8. The climate controlled assembly of claim 1, further comprising at least one remote controller for occupant interaction.

9. The climate controlled assembly of claim 1, wherein the stitching helps isolate different zones so that a temperature conditioning can be customized.

10. The climate controlled assembly of claim 1, wherein the spacer material comprises a spacer fabric.

11. A climate controlled assembly configured for placement on a bed, the assembly comprising:

a flow conditioning member comprising a porous structure configured to distribute air, wherein the flow conditioning member comprises at least one resilient material that is rigid or semi-rigid, the flow conditioning member comprising a porous, intricate internal structure;

wherein the flow conditioning member comprises stitching to control a flow of fluid within the flow conditioning member, wherein the stitching is configured to help prevent the passage of fluids across the stitching within the flow conditioning member, and wherein the stitching passes through the flow conditioning member and helps to fluidly separate fluids passing through porous structures located in adjacent flow condition members;

wherein the stitching creates at least one non-porous area within the flow conditioning member, and wherein the stitching is configured to provide a path for fluid to flow when the assembly is in use; and wherein the flow conditioning member and the cushion member of the bed on which the flow conditioning member is positioned are separate and not attached to one another.

12. The climate controlled assembly of claim 11, further comprising a fluid transfer device in fluid communication with the flow conditioning member via at least one fluid conduit, the fluid transfer device being configured to selectively deliver fluid to the flow conditioning member.

13. The climate controlled assembly of claim 12, further comprising at least one thermoelectric device, wherein fluid transferred by the fluid transfer device passes through or past a thermoelectric device to thermally condition such fluid before it enters the flow conditioning member.

14. The climate controlled assembly of claim 11, further comprising an enclosure, the enclosure at least partially surrounding the flow conditioning member, wherein the enclosure comprises a plurality of openings through which fluid passing through the flow conditioning member exits.

15. The climate controlled assembly of claim 11, further comprising at least one layer positioned above the flow conditioning member to enhance comfort.

16. The climate controlled assembly of claim 11, further comprising at least one remote controller for occupant interaction.

17. The climate controlled assembly of claim 11, wherein the stitching helps isolate different zones so that a temperature conditioning can be customized.

18. The climate controlled assembly of claim 11, wherein the flow conditioning member comprises at least one non-porous area.

19. The climate controlled assembly of claim 11, wherein the porous structure comprises a spacer fabric.

* * * * *